US011352158B2

(12) United States Patent
Stock

(10) Patent No.: US 11,352,158 B2
(45) Date of Patent: Jun. 7, 2022

(54) MACHINE FOR FORMING PACKAGES FROM A WEB OF PREFORMED BAGS

(71) Applicant: Automated Packaging Systems, LLC, Streetsboro, OH (US)

(72) Inventor: John M. Stock, Fairview Park, OH (US)

(73) Assignee: Automated Packaging Systems, LLC, Streetsboro, OH (US)

( * ) Notice: Subject to any disclaimer, the term of this patent is extended or adjusted under 35 U.S.C. 154(b) by 106 days.

(21) Appl. No.: 16/846,653

(22) Filed: Apr. 13, 2020

(65) Prior Publication Data

US 2020/0239173 A1 Jul. 30, 2020

Related U.S. Application Data

(63) Continuation of application No. 15/352,844, filed on Nov. 16, 2016, now Pat. No. 10,633,137.
(Continued)

(51) Int. Cl.

| | |
|---|---|
| ***B65B 61/12*** | (2006.01) |
| ***B65B 43/36*** | (2006.01) |
| ***B65B 51/14*** | (2006.01) |
| ***B65B 43/12*** | (2006.01) |
| ***B65B 5/04*** | (2006.01) |
| ***B65B 43/26*** | (2006.01) |

(Continued)

(52) U.S. Cl.
CPC ..... *B65B 61/12* (2013.01); *B65B 5/045* (2013.01); *B65B 43/123* (2013.01); *B65B 43/267* (2013.01); *B65B 43/36* (2013.01); *B65B 51/146* (2013.01); *B65D 33/002* (2013.01); *B65D 75/44* (2013.01); *B65D 75/46* (2013.01)

(58) Field of Classification Search
CPC ..... B65B 5/045; B65B 43/123; B65B 43/267; B65B 43/30; B65B 43/36; B65B 51/146; B65B 61/12; B65D 33/002; B31B 70/14; B31B 70/148; B31B 70/942; B31B 70/946
USPC ..... 53/459, 469, 572, 284.7, 384.1, 385.1, 53/386.1; 383/37; 493/237, 238
See application file for complete search history.

(56) References Cited

U.S. PATENT DOCUMENTS

| | | | |
|---|---|---|---|
| 2,195,740 A | 4/1940 | Salfisberg | |
| 2,805,814 A | 9/1957 | Calasibetta et al. | |

(Continued)

FOREIGN PATENT DOCUMENTS

| | | | |
|---|---|---|---|
| ES | 2345080 A1 | 9/2010 | |
| FR | 2547794 A1 * | 12/1984 | ..... B65B 43/30 |

(Continued)

OTHER PUBLICATIONS

International Search Report and Written Opinion from PCT/US16/62170 dated Feb. 17, 2017.

*Primary Examiner* — Stephen F. Gerrity
(74) *Attorney, Agent, or Firm* — Jon M. Isaacson

(57) ABSTRACT

An exemplary web of preformed bags includes first and second layers, first and second side, first and second side seals proximate the first and second edges, a plurality of transverse seals extending between the first and second side edges, an opening in the first layer, and a line of separation in the second layer, and first and second cuts in the first and second side seals. The first and second cuts are configured to reduce or eliminate a breaking force necessary to break the first and second side seals when the web is torn along the line of separation.

19 Claims, 24 Drawing Sheets

Related U.S. Application Data

(60) Provisional application No. 62/255,743, filed on Nov. 16, 2015.

(51) Int. Cl.

| | |
|---|---|
| ***B65D 75/44*** | (2006.01) |
| ***B65D 75/46*** | (2006.01) |
| ***B65D 33/00*** | (2006.01) |

(56) References Cited

U.S. PATENT DOCUMENTS

| | | | | |
|---|---|---|---|---|
| 3,057,539 | A | 10/1962 | Leary | |
| 3,254,828 | A | 6/1966 | Lerner | |
| 3,938,299 | A | 2/1976 | Lerner | |
| 4,201,029 | A | 5/1980 | Lerner | |
| 4,306,656 | A | 12/1981 | Dahlem | |
| 4,899,520 | A * | 2/1990 | Lerner et al. | B65B 43/12 493/239 |
| 4,994,128 | A | 2/1991 | Toshima | |
| 5,064,408 | A | 11/1991 | Bridgeman | |
| 5,215,275 | A | 6/1993 | Gold | |
| 5,971,138 | A | 10/1999 | Soughan | |
| 6,343,876 | B2 | 2/2002 | Takahashi et al. | |
| 6,516,587 | B1 | 2/2003 | Chikatani | |
| 6,742,321 | B2 | 6/2004 | Gates | |
| 6,860,843 | B2 | 3/2005 | Hayashi | |
| 6,948,294 | B2 | 9/2005 | Rabiea | |
| 7,093,978 | B2 | 8/2006 | Tan | |
| 8,251,585 | B2 | 8/2012 | Moulin | |
| 10,336,489 | B2 | 7/2019 | Riccardi et al. | |
| 11,066,202 | B2 * | 7/2021 | Williams et al. | B65B 61/12 |
| 2001/0017947 | A1 | 8/2001 | Strand et al. | |
| 2003/0113042 | A1 | 6/2003 | Yeager | |
| 2003/0124294 | A1 | 7/2003 | Hodson et al. | |
| 2003/0169947 | A1 | 9/2003 | Taheri | |
| 2003/0208989 | A1 | 11/2003 | Thomas et al. | |
| 2004/0162205 | A1 | 8/2004 | Baker | |
| 2005/0041889 | A1 | 2/2005 | Scarberry | |
| 2006/0126975 | A1 | 6/2006 | Mckellar | |
| 2006/0233467 | A1 | 10/2006 | Mize, Jr. | |
| 2009/0064637 | A1 | 3/2009 | Riccardi et al. | |
| 2009/0266036 | A1 | 10/2009 | Zerfas et al. | |
| 2011/0162329 | A1 | 7/2011 | So | |
| 2012/0128836 | A1 | 5/2012 | Carroll | |
| 2012/0201480 | A1 | 8/2012 | Goto et al. | |
| 2014/0353192 | A1 | 12/2014 | Dais et al. | |
| 2016/0145030 | A1 | 5/2016 | Malligan et al. | |
| 2016/0176599 | A1 | 6/2016 | Hanus | |

FOREIGN PATENT DOCUMENTS

| | | | | |
|---|---|---|---|---|
| GB | 920516 | A * | 3/1963 | B65D 33/002 |
| WO | WO-2015181242 | A1 * | 12/2015 | B65B 43/30 |

* cited by examiner

MACHINE FOR FORMING PACKAGES FROM A WEB OF PREFORMED BAGS

CROSS-REFERENCE TO RELATED APPLICATIONS

The present application is a continuation of U.S. application Ser. No. 15/352,844, filed on Nov. 16, 2016, which claims the benefit of U.S. Provisional Application Ser. No. 62/255,743, filed on Nov. 16, 2015, the disclosures of both of which are hereby incorporated herein by reference in their entirety.

TECHNICAL FIELD

The present application relates generally to packaging and in particular to preformed bags, a web of preformed bags, and methods of forming and using a web of preformed bags.

BACKGROUND

U.S. Pat. No. 3,254,828, issued Jun. 7, 1966, to Hershey Lerner under the title Flexible Container Strips is directed to so called bags on a roll (here the AutoBag patent). U.S. Pat. No. 3,254,828 is incorporated herein by reference in its entirety. This patent discloses a web of bags interconnected by lines of weakness, preferably in the form of perforations, with each of the bags being open on one face. In use the bags are sequentially fed to a loading station. When at the loading station, each bag is blown open, a product is inserted and thereafter separated from the web and, if desired, the bag is then sealed to form a package.

These container strips in the form of chains of pre-opened bags are supplied either on a roll as taught in the AutoBag patent or festooned in a carton in the manner taught in U.S. Pat. No. 4,201,029, issued May 6, 1980, to Bernard Lerner et al. under the title Method and Apparatus for Packaging, (herein the Wig-Wag patent). Such container strips have been sold by Automated Packaging Systems, Inc. of Streetsboro, Ohio, the assignee of the present case, under the trademark AutoBag and have enjoyed great commercial success.

SUMMARY

Exemplary embodiments of webs of preformed bags and methods of forming the same are disclosed herein.

An exemplary web of preformed bags includes first and second layers, first and second side, first and second side seals proximate the first and second edges, a plurality of transverse seals extending between the first and second side edges, an opening in the first layer, and a line of separation in the second layer, and first and second cuts in the first and second side seals. The first and second cuts are configured to reduce or eliminate a breaking force necessary to break the first and second side seals when the web is torn along the line of separation.

Another exemplary embodiment of the present disclosure relates to a method for forming packages from a web of preformed bags.

The method includes providing a web of preformed bags and opening a bag of the preformed web of bags along an opening. The web of preformed bags includes first and second layers, first and second side, first and second side seals proximate the first and second edges, a plurality of transverse seals extending between the first and second side edges, an opening in the first layer, and a line of separation in the second layer, and first and second cuts in the first and second side seals. The step of opening includes tearing the web along the line of separation and breaking the first and second side seals. The first and second cuts are configured to reduce or eliminate a breaking force necessary to break the first and second side seals during the opening step.

BRIEF DESCRIPTION OF THE DRAWINGS

These and other features and advantages of the present invention will become better understood with regard to the following description and accompanying drawings in which.

DETAILED DESCRIPTION

Figure 1C:
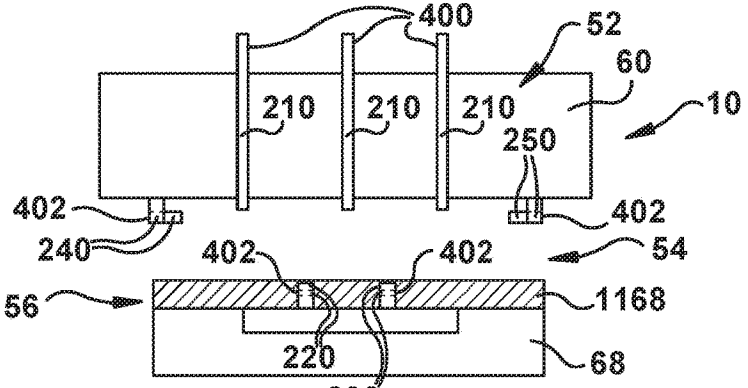
FIG. 1C is a top view of the apparatus shown in FIG. 1A.

Prior to discussing the various embodiments, a review of the definitions of some exemplary terms used throughout the disclosure is appropriate. Both singular and plural forms of all terms fall within each meaning.

As described herein, when one or more components are described as being connected, joined, affixed, coupled, attached, or otherwise interconnected, such interconnection may be direct as between the components or may be indirect such as through the use of one or more intermediary components. Also as described herein, reference to a "member," "component," or "portion" shall not be limited to a single structural member, component, or element but can include an assembly of components, members, or elements. Also as described herein, the terms "substantially" and "about" are defined as at least close to (and includes) a given value or state (preferably within 10% of, more preferably within 1% of, and most preferably within 0.1% of).

The present application relates to an elongated web 16 (FIGS. 14 and 15) of preformed interconnected bags 18. In an exemplary embodiment, the web 16 has an opening 30 defined in a first ply 20 and a line of separation 32 in a second ply 22. The webs 16 of preformed interconnected bags 18 can take a wide variety of different forms. In the exemplary embodiments illustrated by FIGS. 14 and 15, each preformed bag 18 is defined by first and second plies 20, 22 of the web 16. First and second side edges 24, 26 of the web hermetically join the first and second plies. Preformed seals 28 extend between the first and second side edges 24, 26. The opening 30 extends between the first and second side edges 24, 26. The line of separation 32, such as a line of perforations in the second ply 22 extends between the first and second side edges 24, 26. In one exemplary embodiment, the opening 30 is superposed over the line of perforations 32. In another exemplary embodiment, the opening 30 and the line of perforations 32 are offset.

Figure 14:
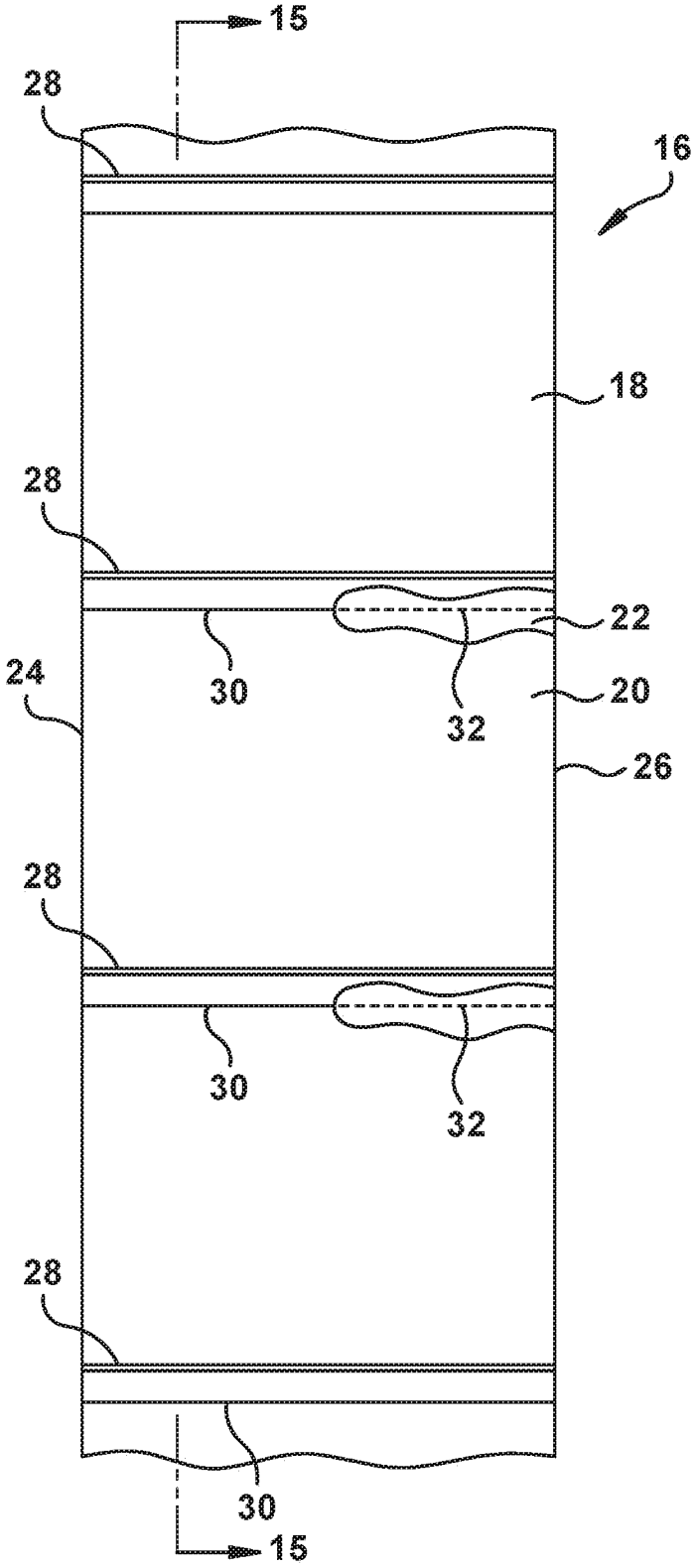
FIG. 14 is a view, partially cut away, of an elongated web of bags.
Figure 15:
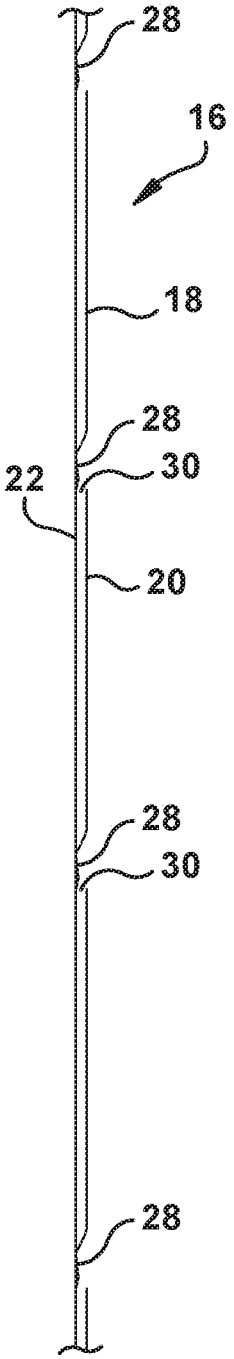
FIG. 15 is a sectional view taken along the plane indicated by lines 15-15 in FIG. 14.

The web 16 of preformed bags 18 illustrated by FIGS. 14 and 15 is one example of the wide variety of different webs that may be used. Examples of acceptable webs of preformed interconnected bags include, but are not limited to, the webs disclosed in U.S. Pat. No. 3,254,828 to H. Lerner and U.S. Pat. No. 5,957,824 to B. Lerner et al., which are incorporated herein by reference in their entirety.

The web 16 may be formed of any suitable material. Examples of suitable materials include, but are not limited to, plastic materials, polyethylene, cellophane, vinyl films, pliofilms, cellulose acetate film, polystyrene, polypropylene, and any heat sealable material.

Figure 17:
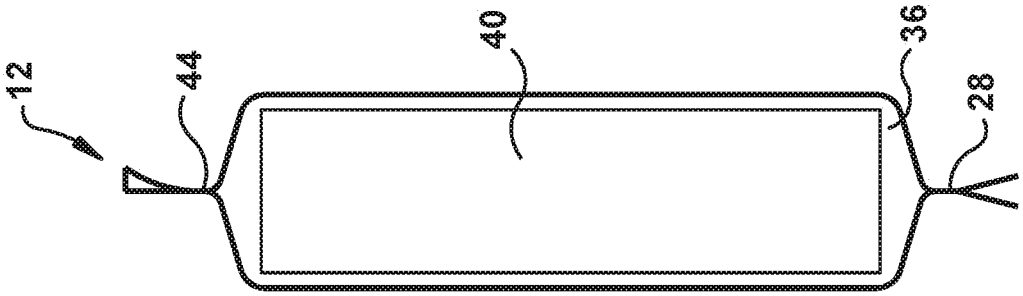
FIG. 17 is a view taken along the plane indicated by lines 17-17 in FIG. 16.
Figure 16:
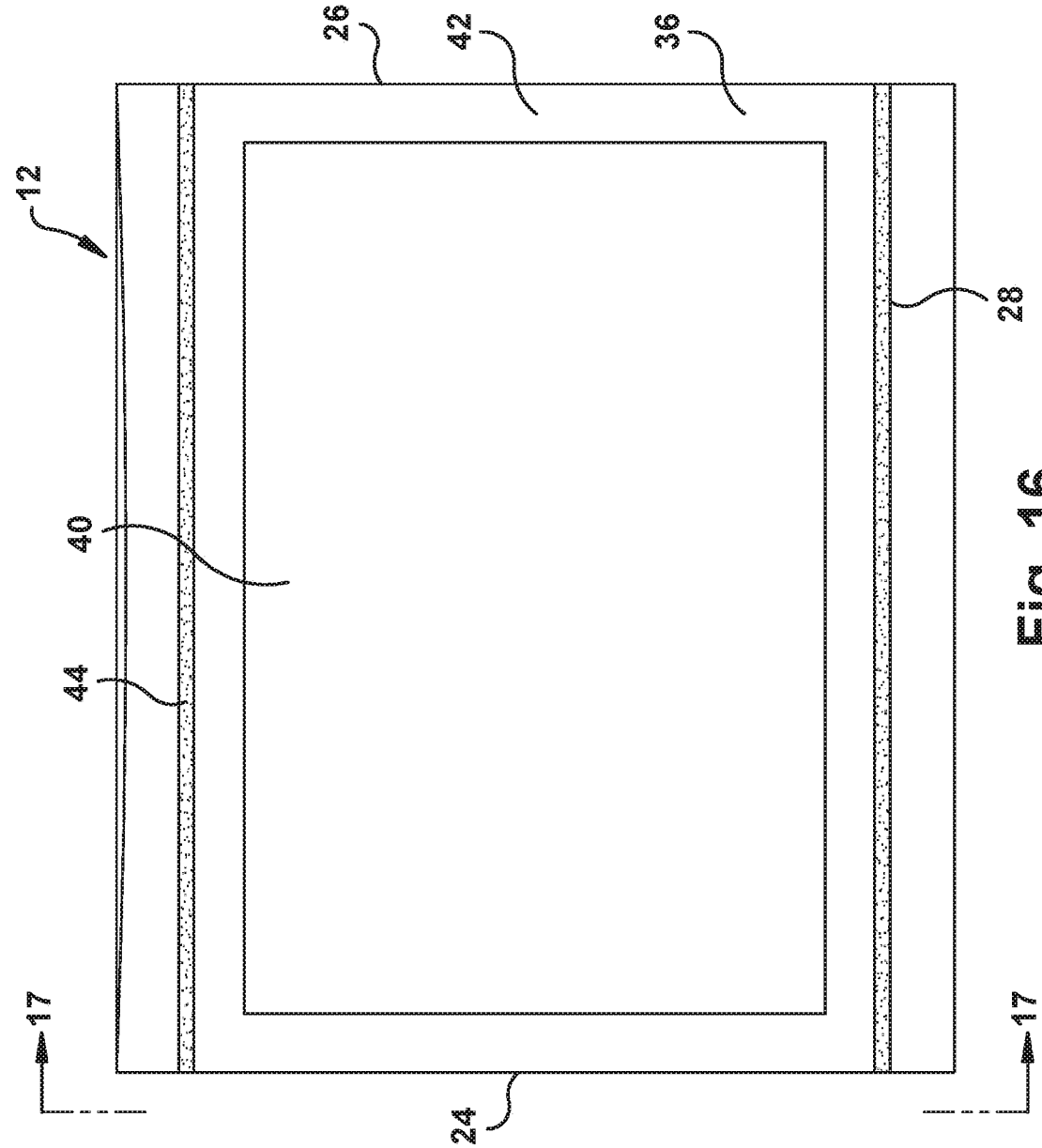
FIG. 16 is a front view of an exemplary embodiment of a package.

Referring to FIGS. 16 and 17, an exemplary package 12 includes a sealed compartment 36. The package 12 may have any number of compartments. Product 40 is disposed in the compartment 36. The illustrated product 40 is a box. However, the package 12 may contain any product. The compartment is defined by the first and second side edges 24, 26, the preformed seal 28, and a seal 44 that is formed after the product 40 is loaded into the bag. In the example, the seal 44 extends from the first side edge 24 to the second side edge 26 to hermetically seal the compartment 36. In another embodiment, the dividing seal 28 may not extend all the way from the first side edge to the second side edge or may be intermittent to allow communication between the compartment 44 and external air or the compartment 44 and another optional compartment of the package. The webs 16 of interconnected bags 18 can be made in a wide variety of different ways.

Figure 1A:
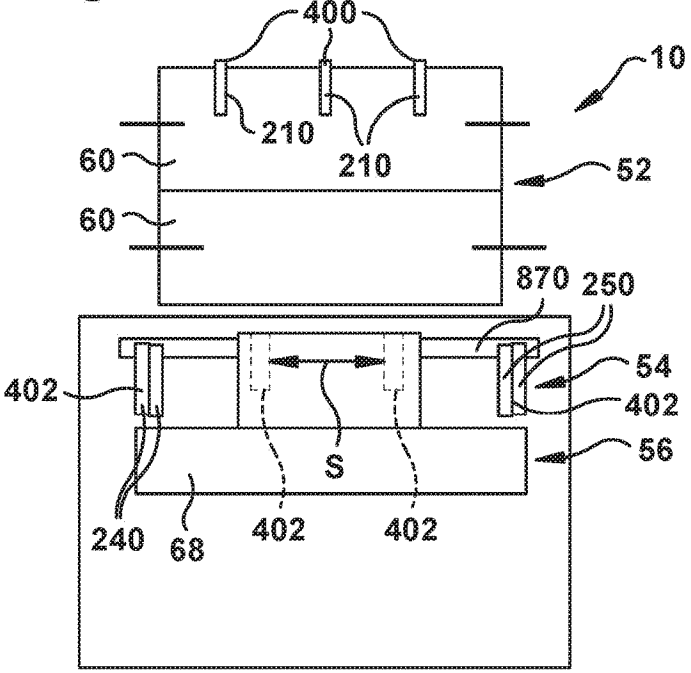
FIG. 1A is a front view of an exemplary apparatus for making packages from an elongated web of preformed interconnected bags.
Figure 1B:
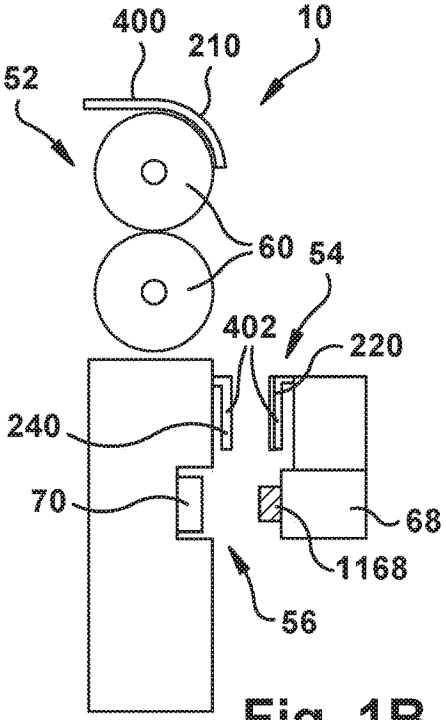
FIG. 1B is a side view of the apparatus shown in FIG. 1A.

The webs 16 of interconnected bags 18 can be used in a wide variety of different applications. For example, the webs 16 of interconnected bags 18 can be used in a wide variety of different packaging machines. FIGS. 1A-1C illustrate an exemplary embodiment of an apparatus 10 or packaging machine for making packages 12 from an elongated web 16 of preformed interconnected bags 18, such as the elongated webs 16 of bags 18 illustrated by FIGS. 14 and 15.

FIGS. 1A-1C through 13A-13C schematically illustrate an exemplary of a machine being operated to make packages 12 from an elongated web 16 of preformed interconnected bags 18. Any apparatus represented by the schematic illustrations of 1A-1C through 13A-13C can be used that performs the functions shown by FIGS. 1A-1C through 13A-13C. The concepts of the apparatus 10 can be implemented in any of a wide variety of packaging machines. For example, U.S. Pat. No. 3,254,468 to H. Lerner, U.S. Pat. No. 4,928,455 to Gereby et al., U.S. Pat. No. 5,341,625 to Kramer, U.S. Pat. No. 5,394,676 to B. Lerner et al., U.S. Pat. No. 6,543,201 to Cronauer et al., U.S. Pat. Nos. 6,742,317, 5,394,676, 5,371,521, and 4,899,520 disclose packaging machines that can be modified in accordance with the present invention to make packages from an elongated web of preformed interconnected bags and are all incorporated herein by reference in their entirety.

Figure 2C:
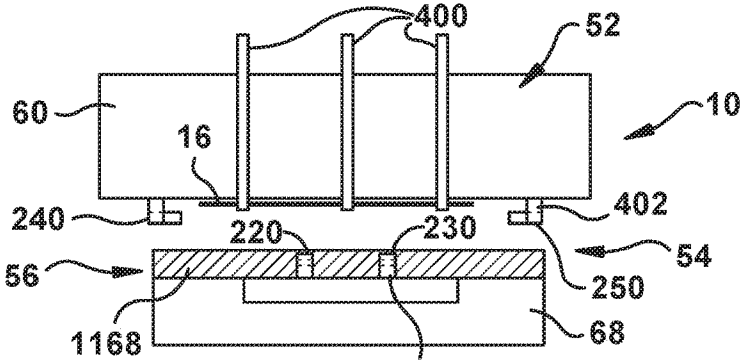
FIG. 2C is a top view of the apparatus and elongated web shown in FIG. 2A.
Figure 2A:
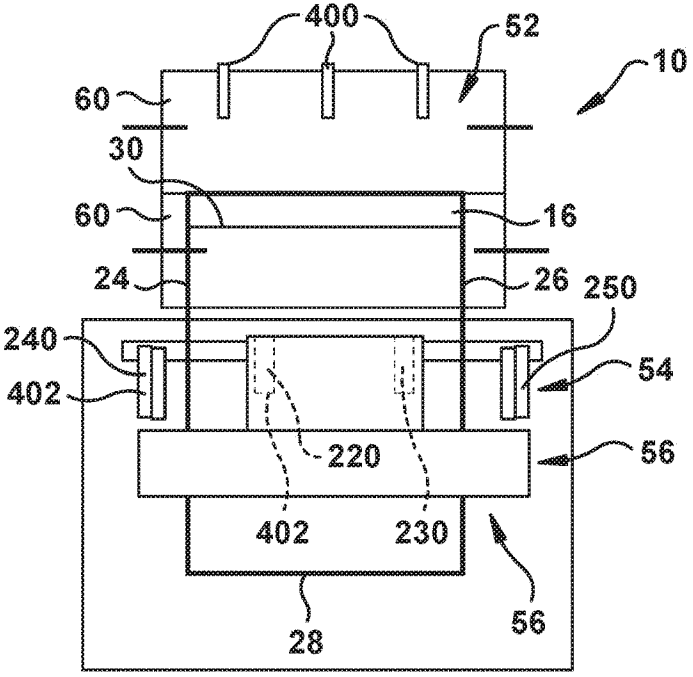
FIG. 2A is a front view of the apparatus showing the elongated web being advanced through the apparatus.
Figure 2B:
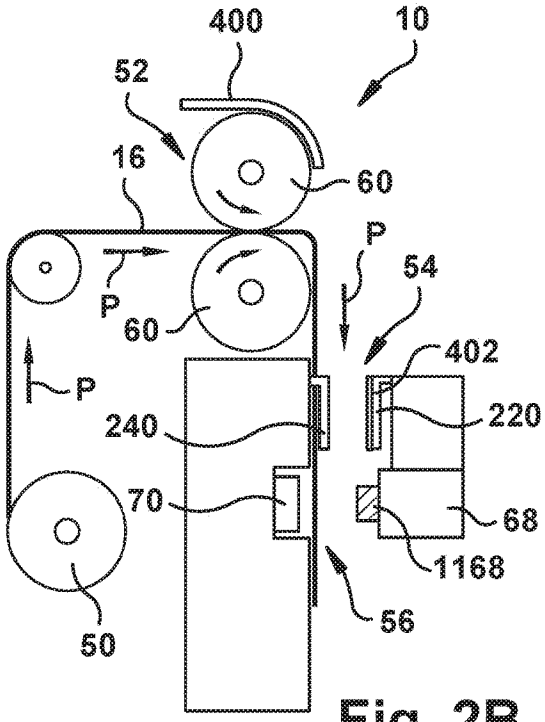
FIG. 2B is a side view of the apparatus and elongated web shown in FIG. 2A.
Figure 3C:
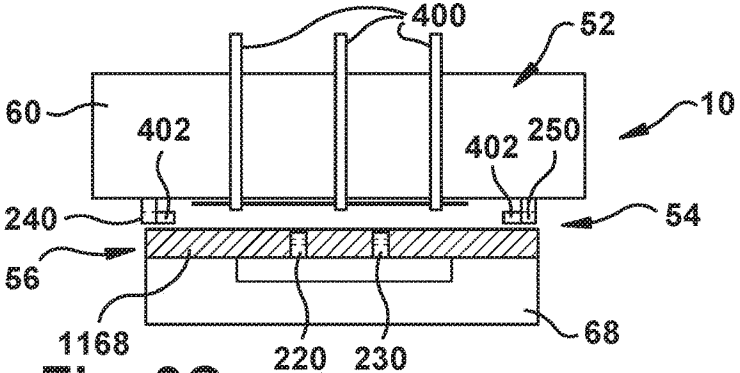
FIG. 3C is a top view of the apparatus and elongated web shown in FIG. 3A.
Figure 3A:
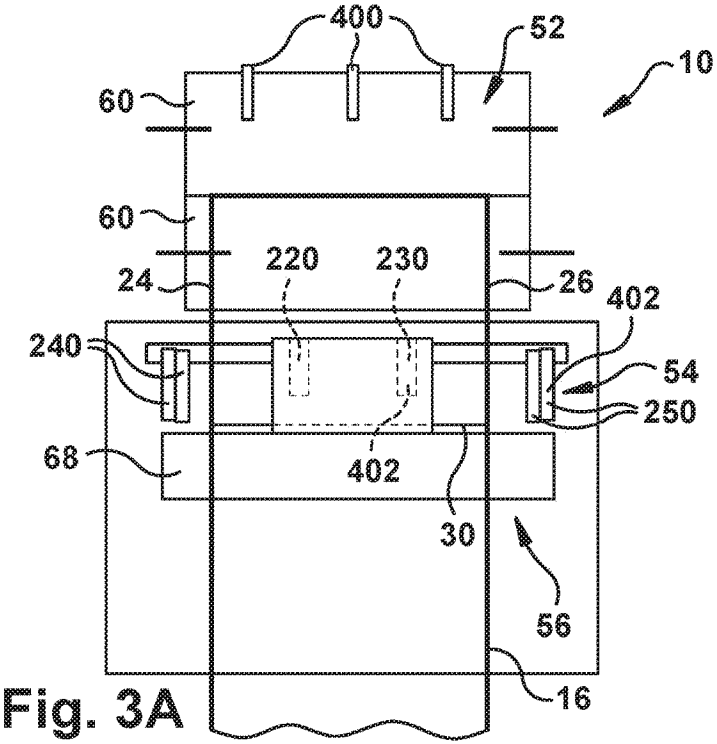
FIG. 3A is a front view of the apparatus showing the elongated web opening being positioned below a bag opening arrangement of the apparatus.
Figure 3B:
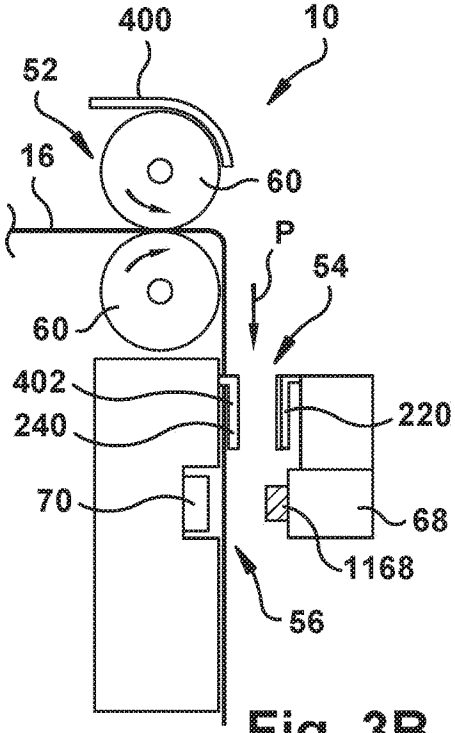
FIG. 3B is a side view of the apparatus and elongated web shown in FIG. 3A.

Referring now to FIGS. 1A-1C, the illustrated apparatus 10 includes a supply 50 (FIG. 2B) of the elongated web 16 of preformed interconnected bags 18, an indexing mechanism 52, an opening arrangement 54, a sealing arrangement 56, and a controller (not shown). The supply 50 comprises the elongated web 16 that is rolled or folded to stage a relatively large amount of the web in a relatively small space. The web 16 is routed from the supply 50 along a path of travel P to the indexing mechanism 52. The indexing mechanism 52 receives the web 16 from the supply and moves the web along the path of travel P. The indexing mechanism 52 may take a wide variety of different forms. For example, any indexing mechanism that can be controlled to index bags of the web to selected positions along the path of travel may be used. In the illustrated example, the indexing mechanism comprises a pair of rollers 60 that form a nip that engages the web 16. The rollers 60 are selectively driven by a motor (not shown) to index bags of the web to selected positions along the path of travel P.

Referring to FIGS. 1A-1C, the opening arrangement 54 is positioned along the path of travel P to open each bag that is to be loaded and sealed. In the illustrated embodiment, the opening arrangement 54 comprises a blower 400 and an engagement device 402. However, the opening arrangement 54 may take a wide variety of different forms. The blower 400 can take a wide variety of different forms. In the illustrated embodiment, the blower 400 comprises a plurality of nozzles 210 positioned above the rollers 60 of the indexing mechanism 52. The illustrated nozzles 210 are oriented downward to blow air downward past the rollers 60 along the path of travel P of the web 18.

The engagement device 402 can take a wide variety of different forms. In the illustrated embodiment, the engagement device 402 comprises a first pair of grippers 220 and a second pair of grippers 230. The first pair of grippers 220 are spaced apart from the second pair of grippers 230 and both are configured to grip the first ply 20 of the bag 18. In one exemplary embodiment, the spacing S (FIG. 1A) between the grippers 220, 230 is adjustable. This optional spacing may be automatic and controlled by the controller or the spacing may be manually adjusted. This allows the engagement device to provide openings 800 (See FIG. 8) having different widths.

The engagement device 402 also includes a third pair of grippers 240 and a fourth pair of grippers 250. The third pair of grippers 240 and the fourth pair of grippers 250 are moveable relative to one another and are configured to grip the side edges 24, 26 of the bag 18. The third and fourth pairs of grippers 240, 250 are omitted from FIGS. 11B, 12B, and 13B to more clearly illustrate opening of the first and second pairs of grippers 220, 230.

The grippers 220 and 230 grip the opening 30 and move to create the rectangular opening 800 as will be described in more detail below. This rectangular opening allows the large items, such as rectangular items, like boxes to be packaged inside the bag 18. While the opening 800 is shown as a rectangular shape, the opening can be any shape. For example, the opening could be a quadrilateral, a trapezoid, a triangle, or any other shape. The number of grippers used to grip the opening 30 of the bag may be increased or decreased to create the desired opening shape. Different shape openings accommodate different shape packages being inserted into the bags.

Referring to FIGS. 1A-1C, the controller is in communication with the indexing arrangement 52, the opening arrangement 54, and the sealing arrangement 56. The controller controls the indexing arrangement 52, the opening arrangement 54, and the sealing arrangement 56 to convert the preformed bags 18 into packages 12. A wide variety of controllers can be used and programmed to control the indexing arrangement 52, the opening arrangement 54, and the sealing arrangement 56 as described herein. For example, the controller and controller algorithms described in U.S. Pat. No. 5,341,625 to Kramer can be modified to control the indexing arrangement 52, the opening arrangement 54, and the sealing arrangement 56 to form the packages.

Referring to FIGS. 2A-2C and 3A-3C, the controller controls the indexing mechanism 52 to index the web 16 forward along the path of travel as indicated by arrows P, until the opening 30 of the bag 18 is just below the engagement device 402 in the exemplary embodiment. In alternate embodiments, the opening 30 is indexed to other positions. For example, the opening 30 can be indexed to any position where the blower 400 can blow the opening 30 open or at least partially open. For example, the opening 30 may initially be positioned above the engagement device 402, be blown open by the blower 400, and then be moved to the position illustrated by FIGS. 3A-3C.

Figure 4C:
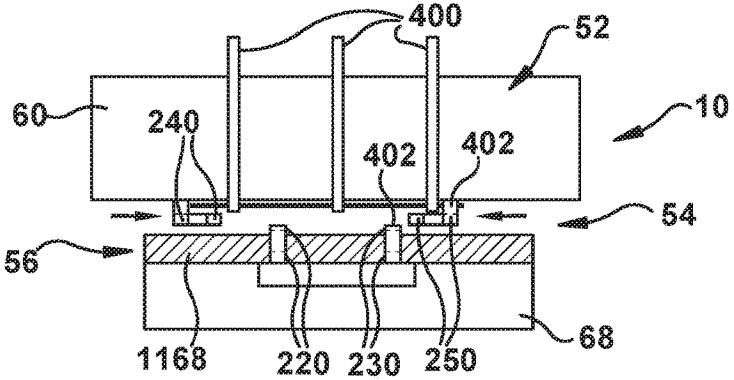
FIG. 4C is a top view of the apparatus and elongated web shown in FIG. 4A.
Figure 4A:
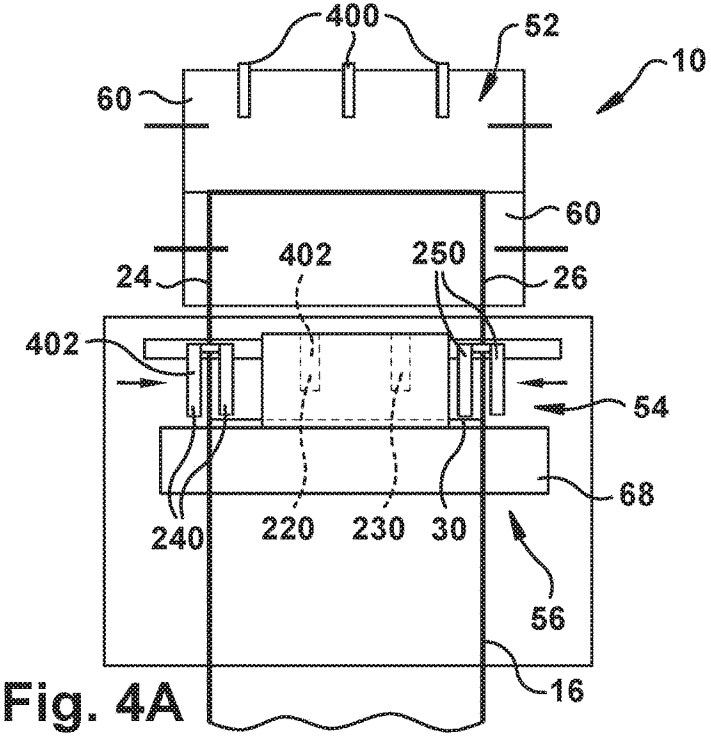
FIG. 4A is a front view of the apparatus showing bag engagement devices moved into position above the elongated web opening.
Figure 4B:
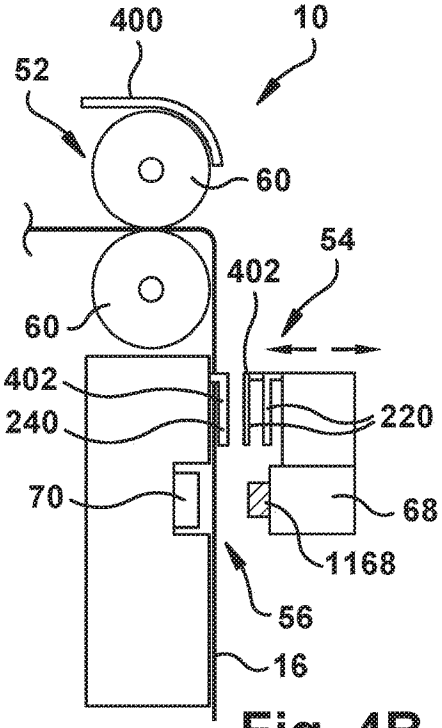
FIG. 4B is a side view of the apparatus and elongated web shown in FIG. 4A.
Figure 5C:
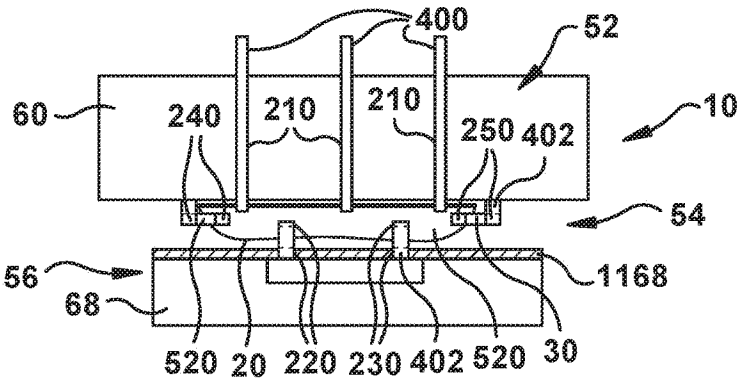
FIG. 5C is a top view of the apparatus and elongated web shown in FIG. 5A.
Figure 5A:
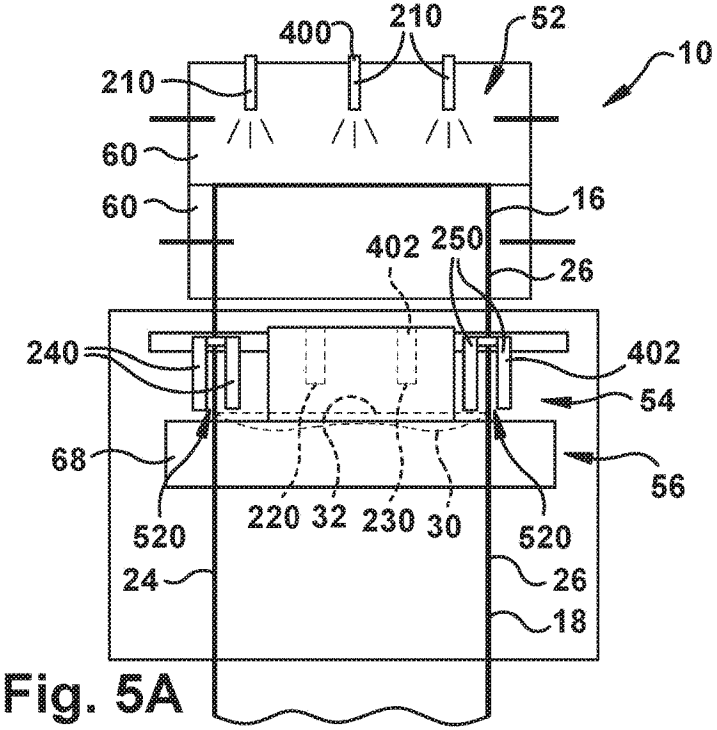
FIG. 5A is a front view of the apparatus showing the web opening being blown open above the bag engagement devices.
Figure 5B:
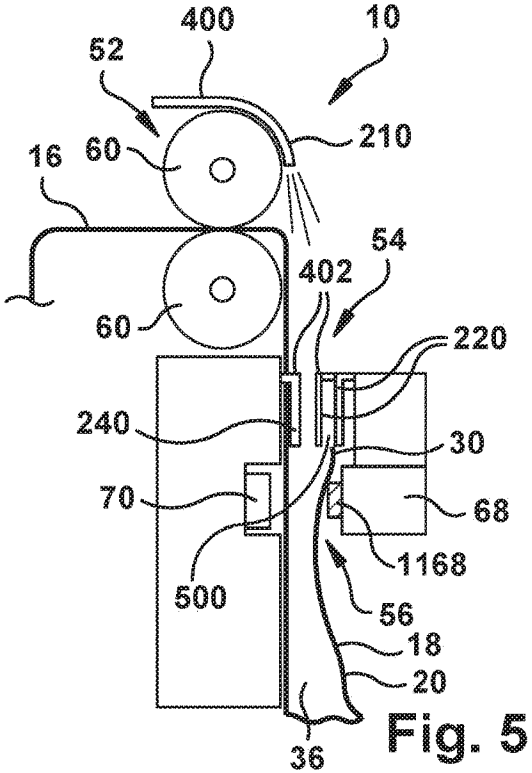
FIG. 5B is a side view of the apparatus and elongated web shown in FIG. 5A.

In an exemplary embodiment, the controller controls the engagement device to move the grippers 220, 230, 240, 250 from a closed position (See FIGS. 3A-3C) to an open position (See FIG. 4A-4C) once the opening 30 is positioned below the engagement device 402. Referring to FIGS. 5A-5C, the controller controls the blower 400 to blow air between the plies 20, 22 at the opening 30 of the bag. The air is forced between the plies through the opening 30 to inflate the bag 18. In an exemplary embodiment, the first ply 20 of the inflated bag 18 is generally aligned with or aligned with a gap 500 (see FIG. 5B) between the gripping members of each pair of open gripper 220, 230. In an exemplary embodiment, the edges of the inflated bag 18 are generally aligned with or aligned with a gap 520 (see FIGS. 5A and 5C) between the gripping members of each open pair of grippers 240, 250. In another embodiment, the bag 18 is not inflated but opened by other means just enough to allow the grippers 220, 230, 240, 250 to be inserted into the opening 30 of the bag.

Figure 6C:
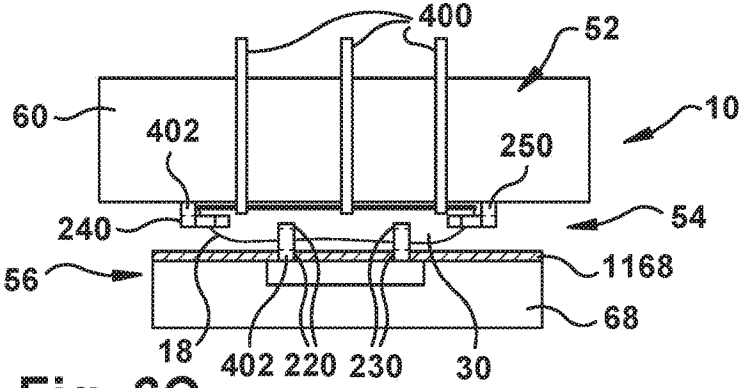
FIG. 6C is a top view of the apparatus and elongated web shown in FIG. 6A.
Figure 6A:
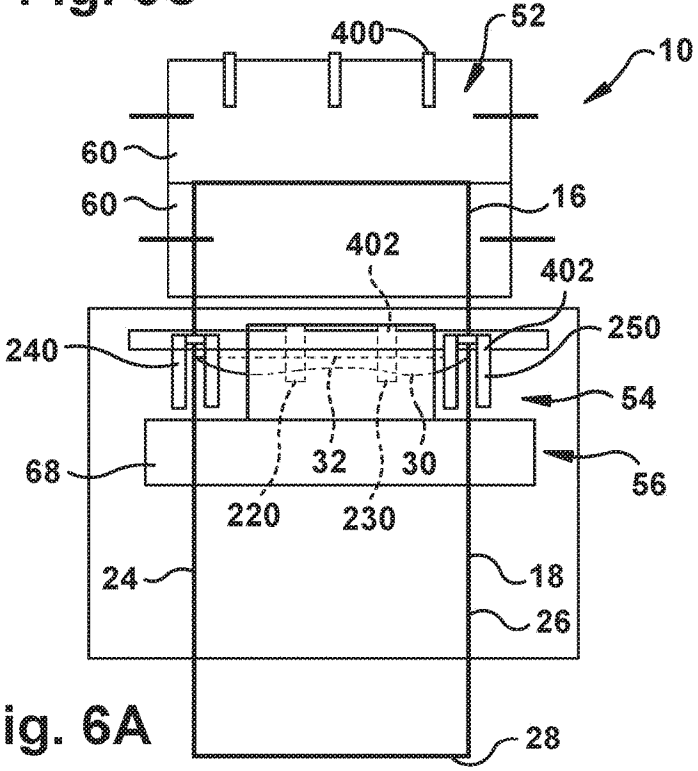
FIG. 6A is a front view of the apparatus showing the web being reverse indexed to position the bag engagement devices inside the web opening.
Figure 6B:
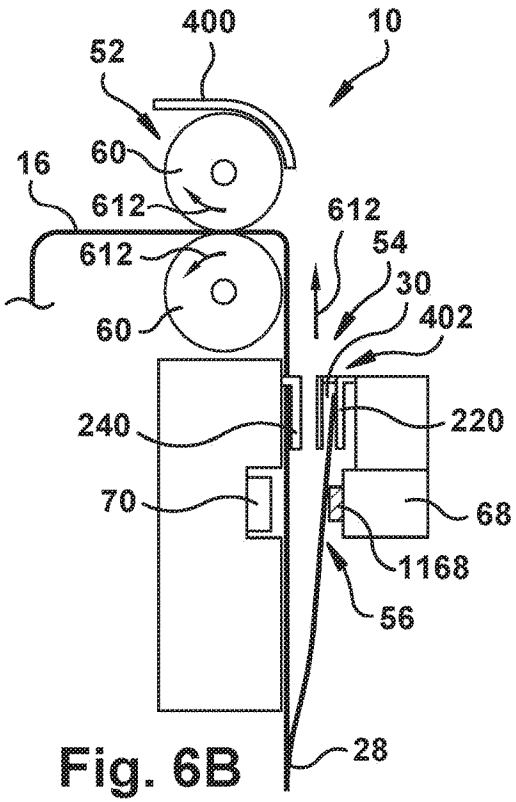
FIG. 6B is a side view of the apparatus and elongated web shown in FIG. 6A.

Referring to FIGS. 6A-6C, in an exemplary embodiment the controller causes the indexing mechanism 52 to reverse index the web as indicated by arrow 612 while the pairs of grippers 220, 230 are open. The blower 400 may optionally be stopped during the reverse indexing. The reverse indexing pulls the first ply 20 of the bag 18 into the gap 500 between the gripping members of each pair of open grippers 220, 230. The reverse indexing also pulls the edges 24, 26 of the bag 18 into the gap 520 between the gripping members of each pair of open grippers 240, 250.

Figure 7C:
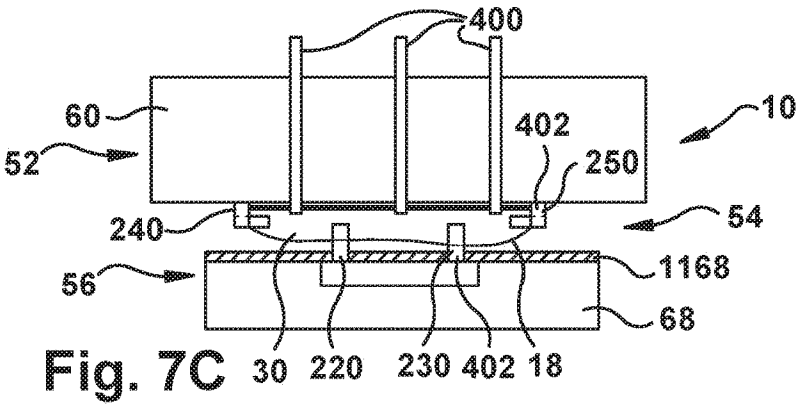
FIG. 7C is a top view of the apparatus and elongated web shown in FIG. 7A.
Figure 7A:
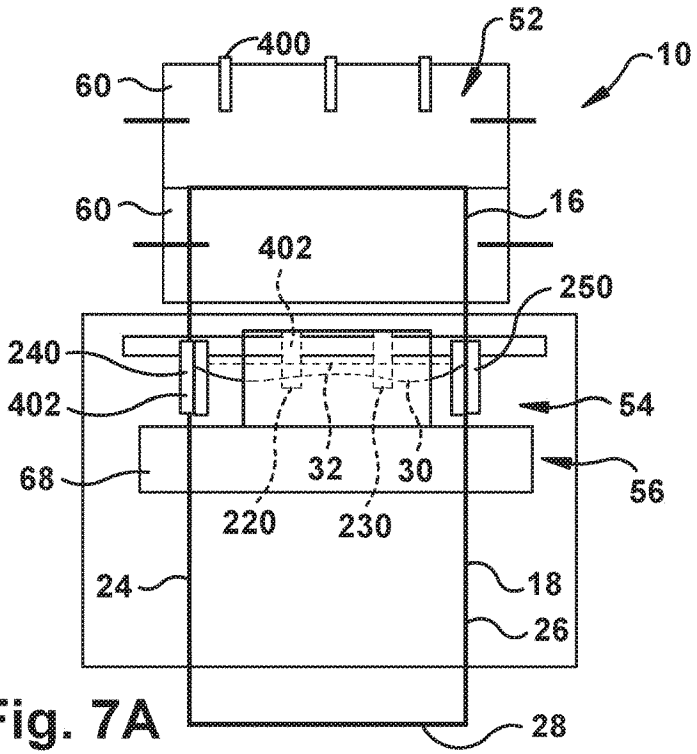
FIG. 7A is a front view of the apparatus showing bag engagement devices engaging a bag of the web at the opening.
Figure 7B:
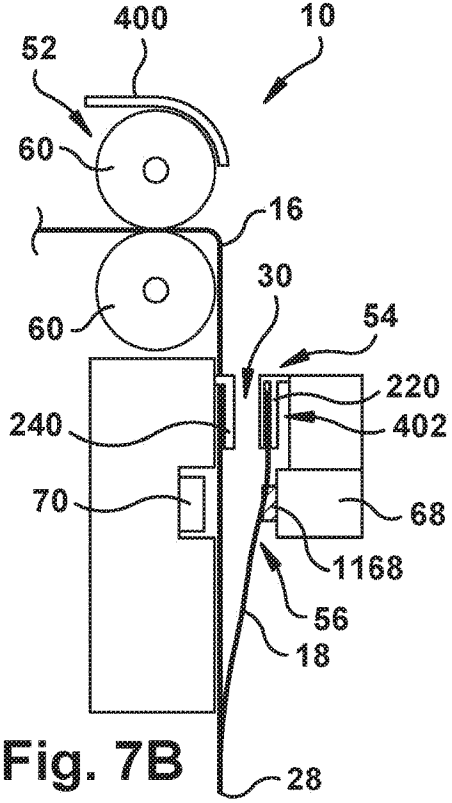
FIG. 7B is a side view of the apparatus and elongated web shown in FIG. 7A.

Referring to FIGS. 7A-7C, in an exemplary embodiment the controller causes the pairs of grippers 220, 230, 240, 250 to move from the open position to the closed position. The first ply 20 of the bag 18 is gripped between the gripping members of each of the pairs of gripper 220, 230. The edges 24, 26 of the bag 18 are gripped between the gripping members of each pair of grippers 240, 250.

Figure 8C:
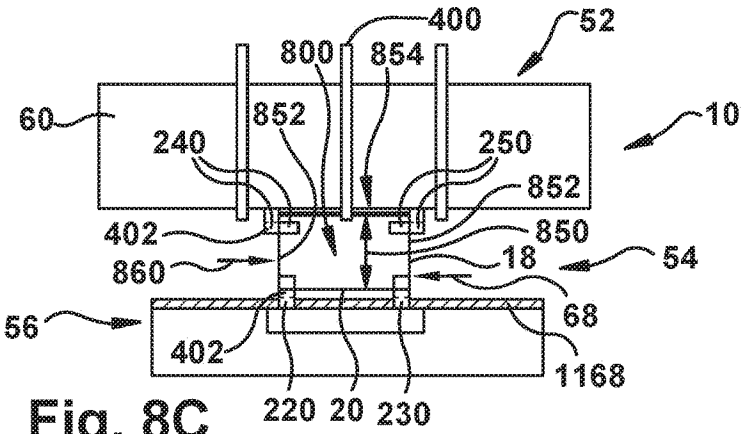
FIG. 8C is a top view of the apparatus and elongated web shown in FIG. 8A.
Figure 8A:
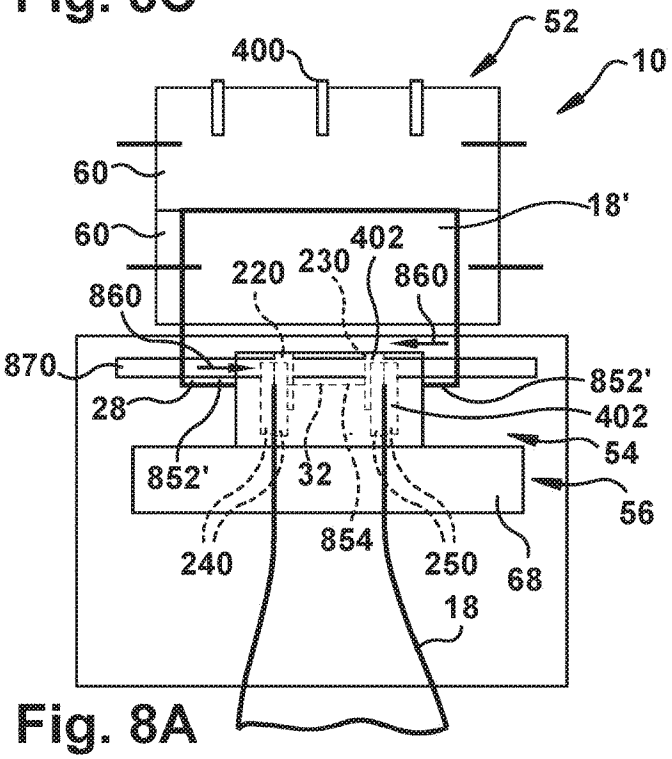
FIG. 8A is a front view of the apparatus showing the engagement devices moving to provide a rectangular bag opening.
Figure 8B:
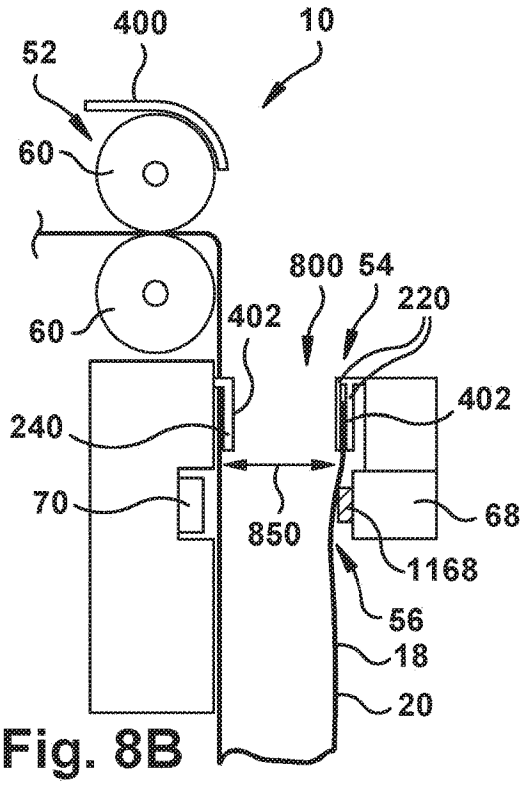
FIG. 8B is a side view of the apparatus and elongated web shown in FIG. 8A.
Figure 9C:
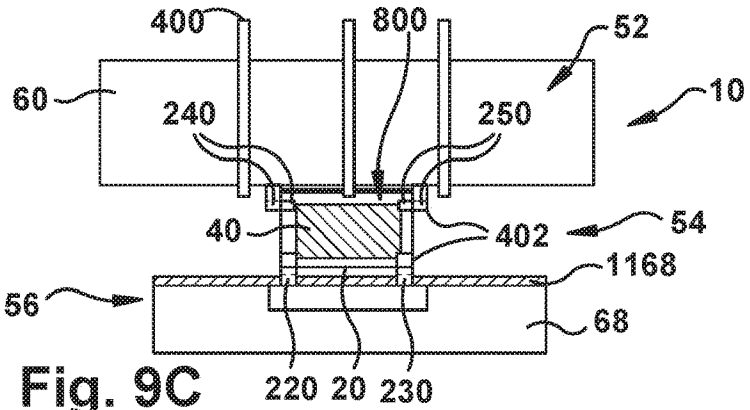
FIG. 9C is a top view of the apparatus and elongated web shown in FIG. 9A.
Figure 9A:
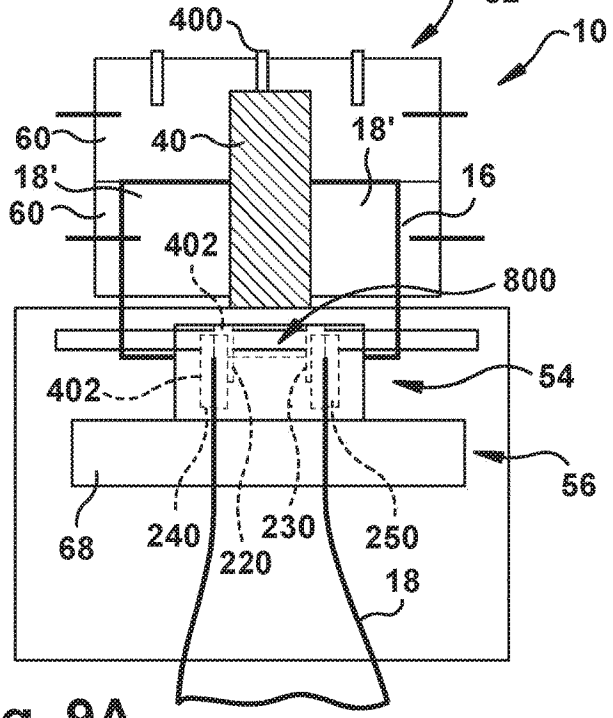
FIG. 9A is a front view of the apparatus showing a rectangular product positioned above the rectangular bag opening.
Figure 9B:
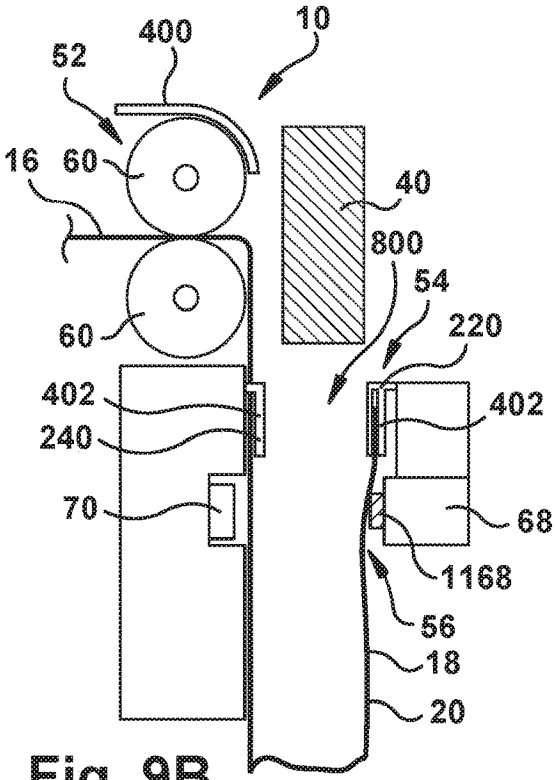
FIG. 9B is a side view of the apparatus and elongated web shown in FIG. 9A.
Figure 10C:
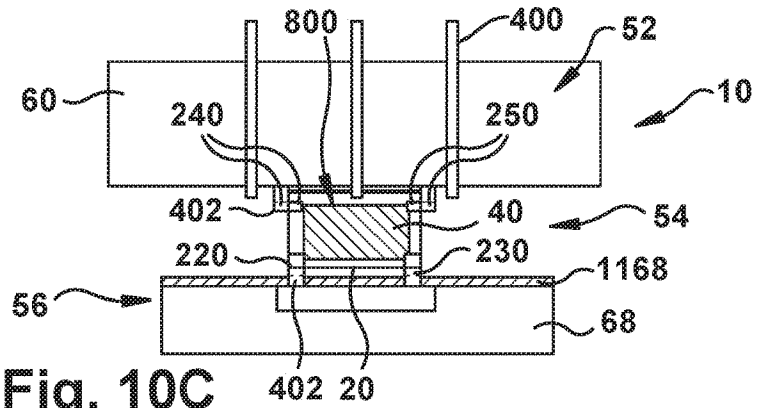
FIG. 10C is a top view of the apparatus and elongated web shown in FIG. 10A.
Figure 10A:
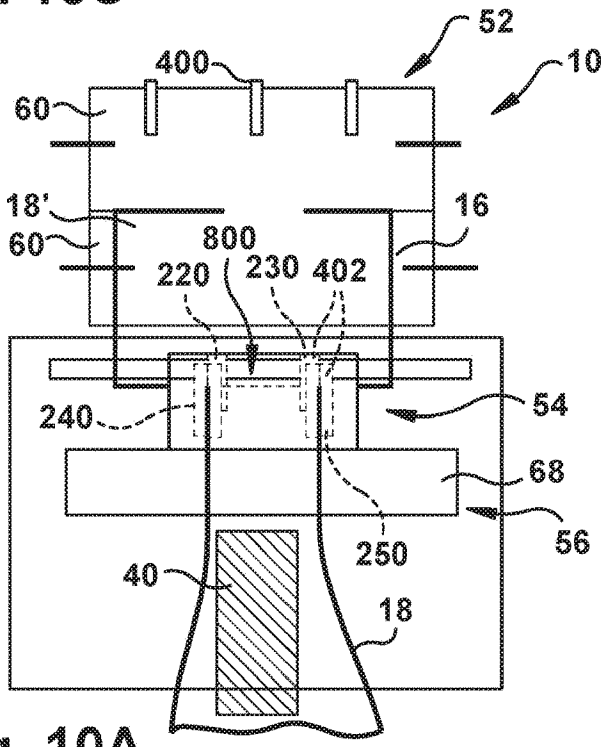
FIG. 10A is a front view of the apparatus showing a rectangular product positioned in the open bag.
Figure 10B:
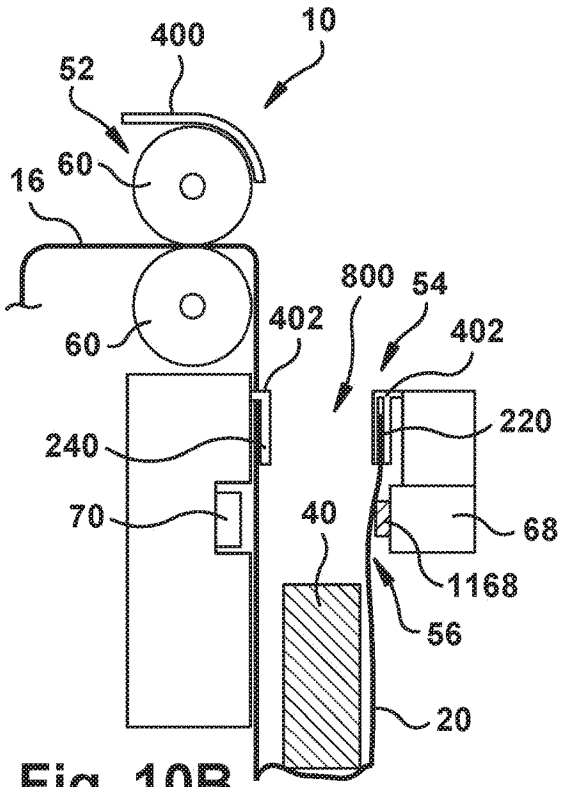
FIG. 10B is a side view of the apparatus and elongated web shown in FIG. 10A.

Referring to FIGS. 8A-8C, each bag 18 is provided with a rectangular opening 800 at a position where the bag is loaded with a product 40. Referring to FIGS. 8A-8C, in an exemplary embodiment, the controller controls the engagement device 402 to provide the bag 18 with the rectangular opening 800 for loading. In the illustrated embodiment, the pairs of gripping members 220, 230 move the first ply 20 away from the second ply 22 as indicated by arrows 850 (see FIGS. 8B and 8C). At the same time, the pairs of gripping members 240, 250 move the edges 24, 26 toward each other as indicated by arrows 860 (see FIGS. 8A and 8C). The movement of the pairs of gripping members 240, 250 tears the line of perforations 32 in the second layer 22. As such, edge portions 852 of the bag 18 are torn away from edge portions 852' of the next bag 18', allowing the rectangular opening 800 to be formed. In one exemplary embodiment, the second ply 22 slides between the pairs of gripping members 240, 250 as the pairs of gripping members 240, 250 move from the position illustrated by FIGS. 7A-7C to the position illustrated by FIGS. 8A-8C. A center portion 854 of the line of perforations 32 in the second layer 22 of the bag 18 remains in-tact. This leaves the bag 18 connected to the bag 18' while the bag 18 has the rectangular opening 800.

The pairs of gripping members 220, 230 can move the first ply 20 away from the second ply 22 in a wide variety of different ways. In the illustrated embodiment, the pairs of gripping members 220, 230 are attached to a bar 68 that is part of the sealing assembly 56. In this embodiment, the bar 68 moves the attached pairs of gripping members 220, 230. However, the pairs of gripping members 220, 230 can be moved by an actuator that is separate from the bar 68. The pairs of gripping members 240, 250 can move the edges 24, 26 toward each other in a variety of different ways. In the illustrated embodiment, the pairs of gripping members 240, 250 move in a slot 870 in a housing of the apparatus 10. The pairs of gripping members 240, 250 can be driven by a motor, a linear actuator or any other mechanism.

Referring to FIGS. 9A-9C and 10A-10C, the bag 18 is maintained with the rectangular opening 800 at the load position and the product 40 is loaded into the bag 18. The product may be loaded manually or automatically. In the illustrated embodiment, the position where the bag 18 is loaded is also the position where bag 18 is sealed after the rectangular opening 800 is closed. In another embodiment, the position where the bag is loaded is different than the position where the bag is sealed. In this embodiment, the controller causes the indexing mechanism 52 to move the bag 18 to the seal position after the bag is loaded with product 40 and closed.

In an exemplary embodiment, once the product is loaded in the bag 18, an operator may provide a signal to the controller that indicates that loading is complete or completion of loading may be automatically detected. The apparatus 10 may be configured to allow the operator to provide the completed loading signal to the controller in a wide variety of different ways. For example, the apparatus may have a control foot pedal (not shown) or the sealing arrangement 56 may have a portion that the operator can push on to indicate that loading is complete and it is time to seal the package. Similarly, the apparatus can be configured to automatically detect completed loading and provide the controller with a signal that indicated this fact. For example, the apparatus may include a counter or may weigh the package to detect completed loading.

Figure 11C:
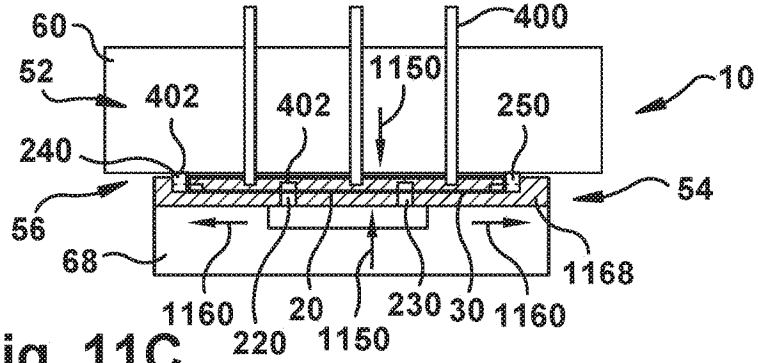
FIG. 11C is a top view of the apparatus and elongated web shown in FIG. 11A.
Figure 11A:
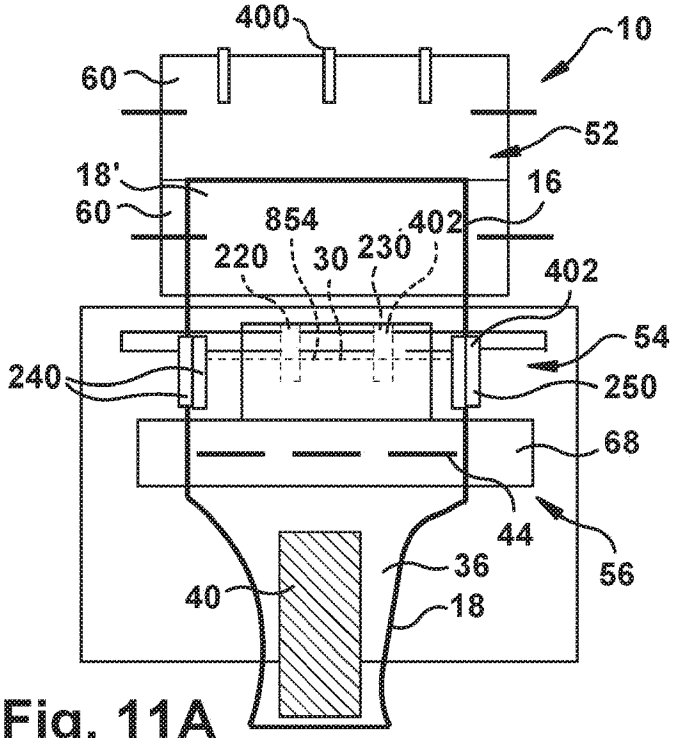
FIG. 11A is a front view of the apparatus showing the bag engagement devices moving to close the bag and the bag being sealed by a sealing arrangement of the apparatus.
Figure 11B:
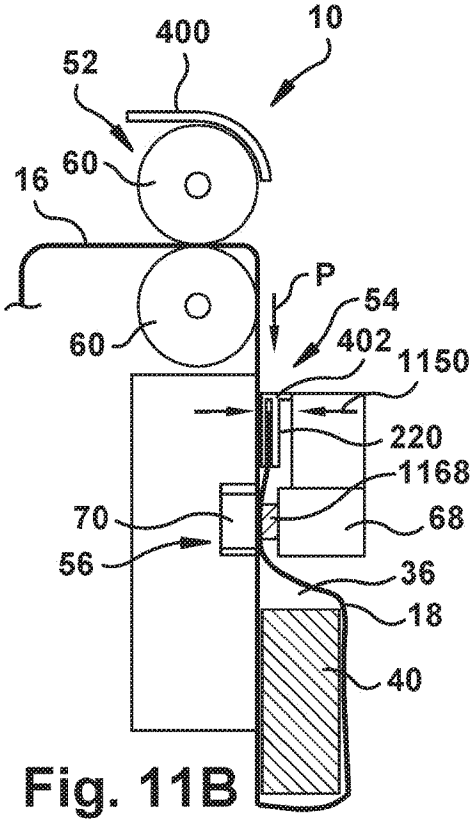
FIG. 11B is a side view of the apparatus and elongated web shown in FIG. 11A.

Referring to FIGS. 11A-11C, the signal from the operator or detection of completed loading is communicated to the controller, and causes the engagement device 402 to close the bag. In the illustrated embodiment, the pairs of gripping members 220, 230 move the first ply 20 back toward the second ply 22 as indicated by arrows 1150 (see FIGS. 11B and 11C). At the same time, the pairs of gripping members 240, 250 move the edges 24, 26 away from each other as indicated by arrows 1160 to close the bag opening 30 (see FIG. 11C). In an exemplary embodiment, the second ply 22 slides through each of the pairs of gripping members 240, 250 as the pairs of gripping members 240, 250 move from the position illustrated by FIGS. 10A-10C to the position illustrated by FIGS. 11A-11C. In the illustrated embodiment, the center portion 854 of the line of perforations 32 in the second layer 22 of the bag 18 remains in-tact. As such, the closed bag 18 remains connected to the bag 18'.

Still referring to FIGS. 11A-11C, the bag may be sealed at the position illustrated by FIGS. 11A-11C or the engagement device 402 may release the bag and the bag may be indexed to another position for sealing. In one exemplary embodiment, the bag is sealed while the engagement device 402 is holding the bag 18 closed. The sealing arrangement 56 is positioned along the path of travel P to provide the seal 44. The sealing arrangement 56 may take a wide variety of different forms. For example, any mechanism that applies heat to the web to seal the first and second webs together to form the seal 44 may be implemented.

In the illustrated embodiment, the sealing arrangement comprises a seal backing bar 68 and a heating element 70 that are that is selectively moved into and out of engagement. Referring to FIG. 11B, when the web is in the seal position, the controller controls the sealing arrangement 56 to clamp the web 16 between the seal backing bar 68 and the heating element 70. In an exemplary embodiment, the seal backing bar 68 comprises a rubber seal backing element 1168. The seal backing bar 68 may be moved to the clamped position (see FIG. 11B) from the unclamped position (See FIG. 10B) under a low force, such as a force that is lower than a force that could injure a finger that might be between the rubber seal backing element 1168 and the heating element 70. In addition, the rubber seal backing element 1168 is not heated.

In an exemplary embodiment, the heating element 70 is moved to the clamped position (See FIG. 11B) from the unclamped position (See FIG. 10B) and/or heat is applied by the heating element 70 only after the rubber seal backing element 1168 has been moved to the clamped position. Heat is applied to the web to seal the plies of the web together between the first side edge 24 and the second side edge 26. The heating element 70 may be continuously on (i.e. always hot when the machine is turned on) or the heating element 70 may be controlled to only apply heat when the bag 18 is clamped and/or a seal signal is provided by the controller. The first and second plies 20, 22 are sealed together to form the compartment 36.

FIGS. 18A-18E illustrate and exemplary embodiment of a sealing assembly 56 that comprises a seal backing bar 68 and a heating element 70 that are that is selectively moved into and out of engagement. In the exemplary embodiment, the heating element 70 is moved by an actuator 1800, such as a pneumatic actuator or a solenoid actuator. The illustrated seal backing bar 68 is moved by a low force actuator 1810 and is held in place by a clamping actuator 1820.

The low force actuator 1810 can take a wide variety of different forms. In one exemplary embodiment, the low force actuator 1810 comprises a servomotor 1812. In the illustrated embodiment, the servomotor 1812 drives a pinion gear 1814 that drives a gear rack 1816. However, any drive arrangement can be employed. In an exemplary embodiment, the low force actuator applies a low force, such as a force that is lower than a force that could injure a person's finger that might be between the seal backing bar 68 and a front panel 1850 of the machine.

The clamping actuator 1820 can take a wide variety of different forms. In one exemplary embodiment, the clamping actuator 1820 is a pneumatic actuator or a solenoid actuator. Any type of actuator can be used. In the illustrated embodiment, the clamping actuator 1820 includes a latch member 1822 for selectively coupling the clamping actuator 1820 to the low force actuator 1810 and decoupling the clamping actuator 1820 from the low force actuator 1810.

Figure 18A:
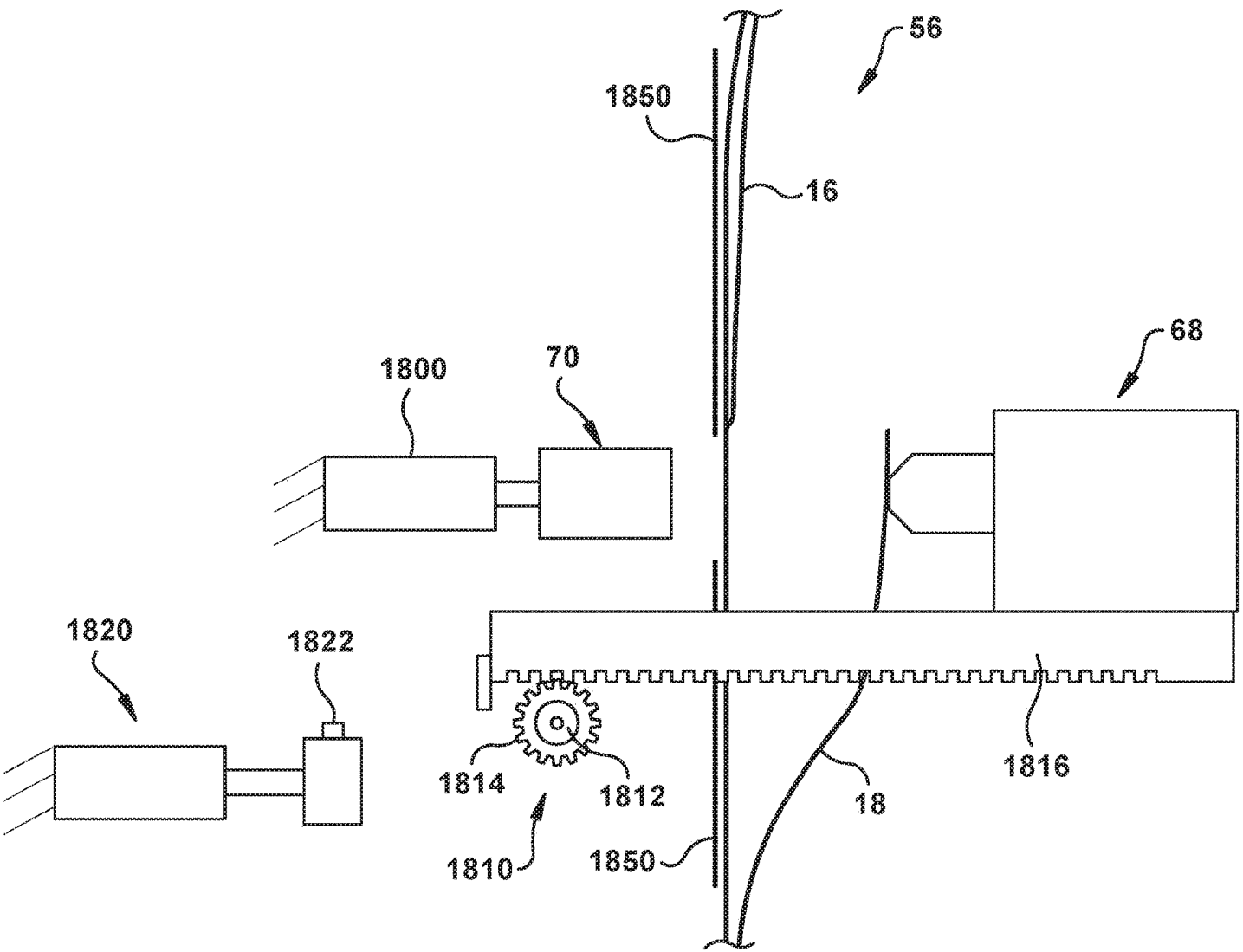
FIGS. 18A-18E illustrate an exemplary embodiment of a sealing assembly.
Figure 18B:
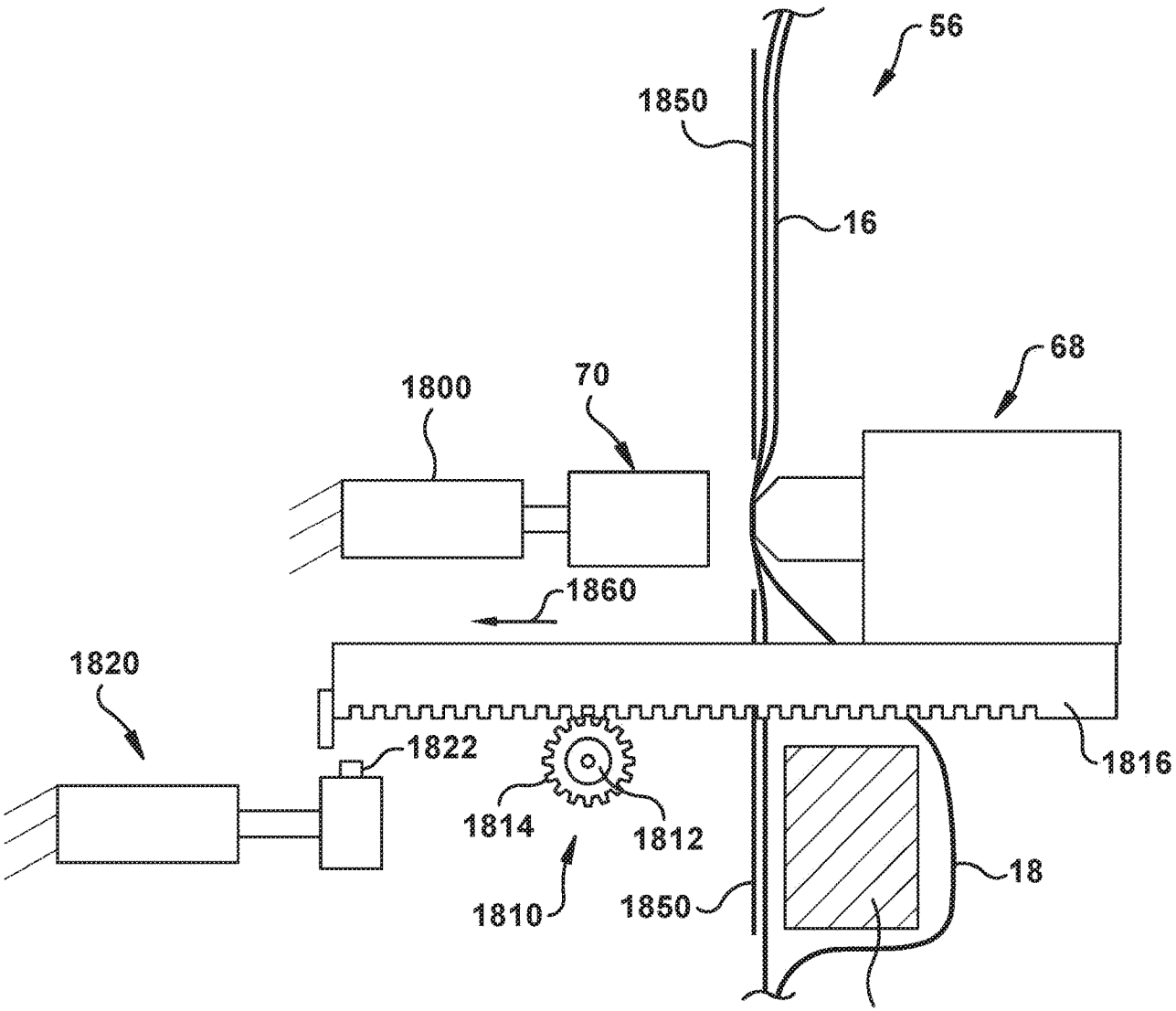
Figure 18C:
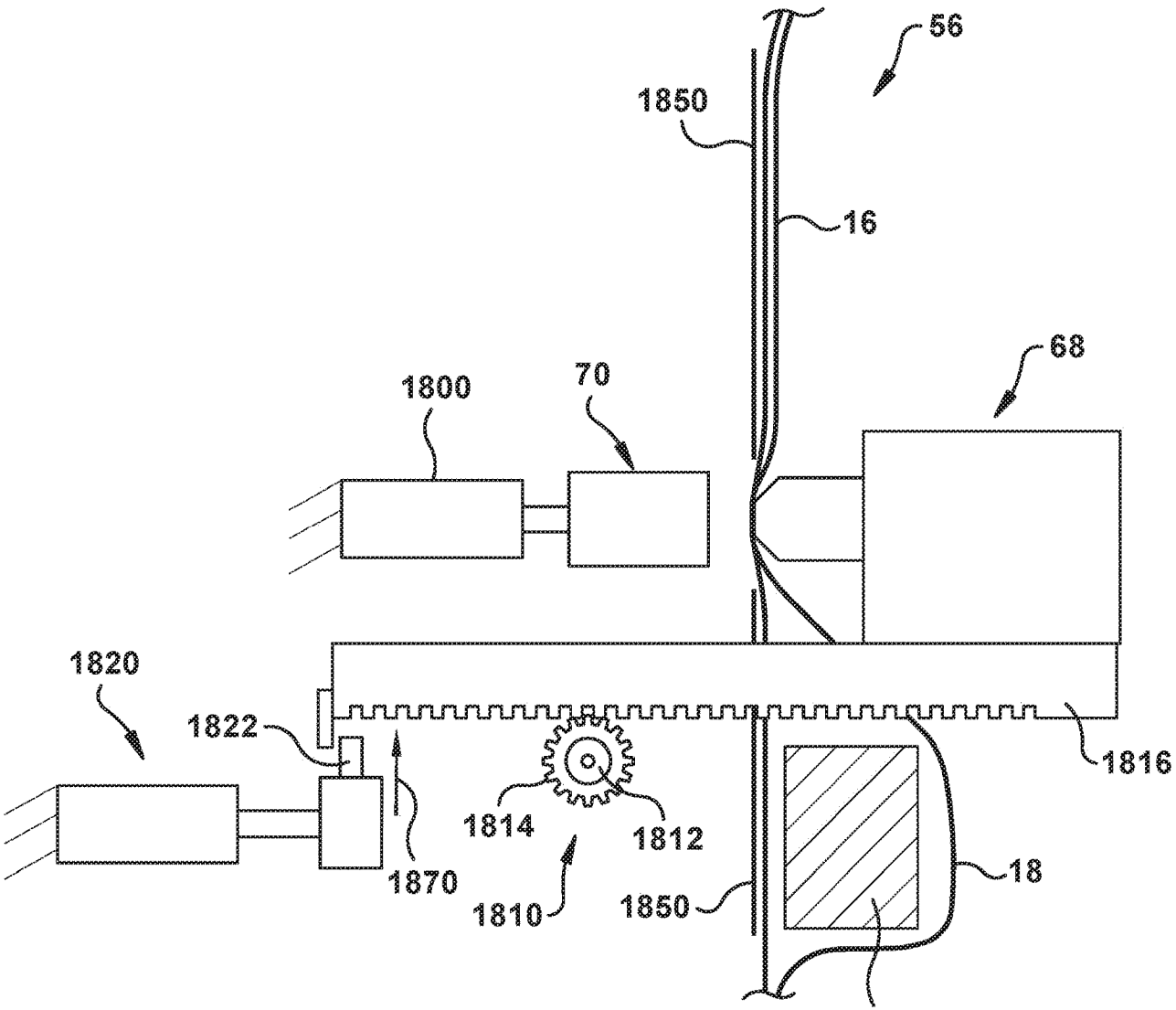
Figure 18D:
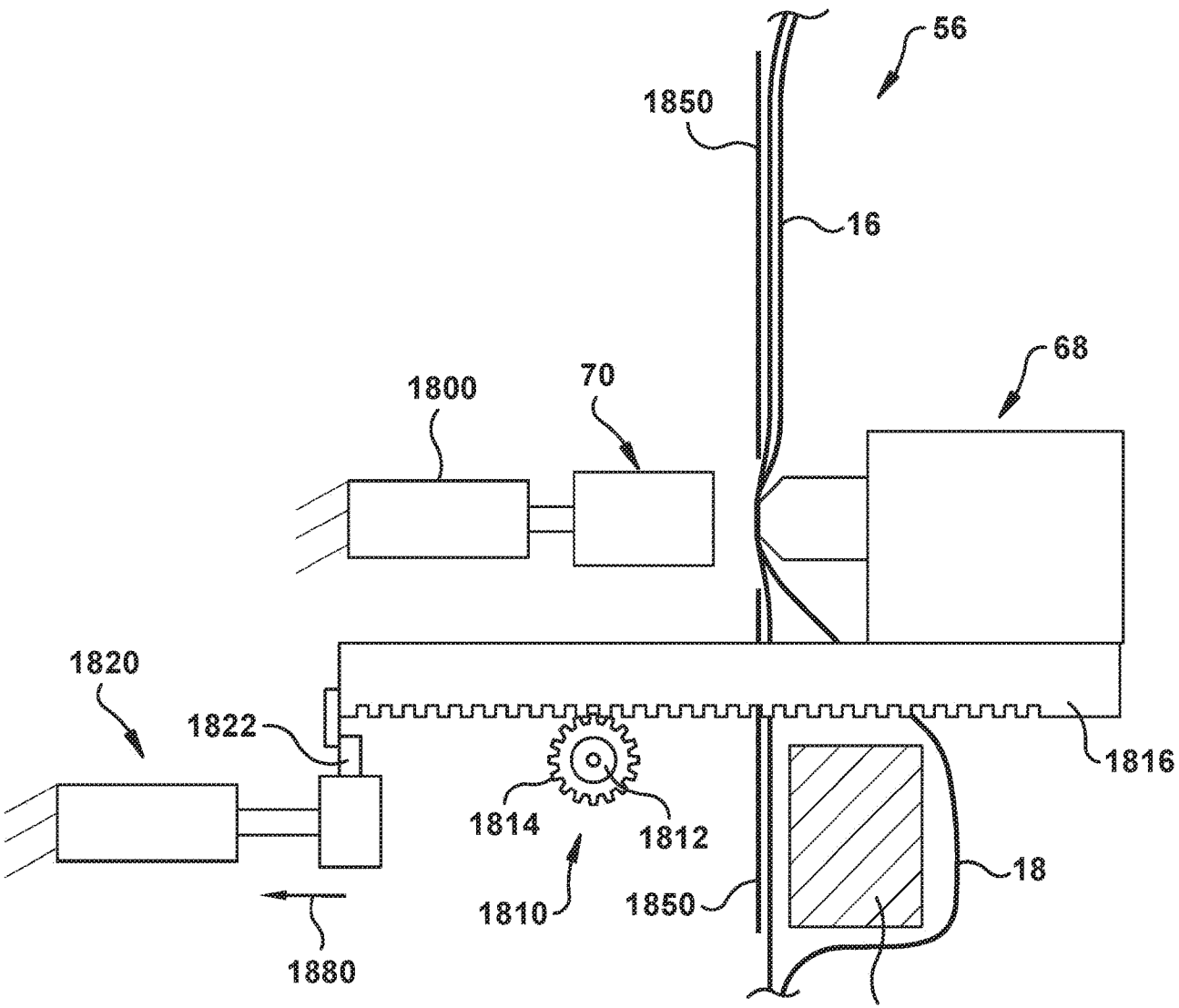

FIG. 18A illustrates the sealing assembly 56 in an open or load position, In the open or load position, the low force actuator 1810 positions the seal backing bar 68 in a spaced apart relationship to a front panel 1850 of the machine 10. In this position, the actuator 1800 positions the heating element 70 in a recessed relationship with respect to the front panel 1850. This prevents a user from inadvertently touching the heating element. Arrow 1860 in FIG. 18B illustrates the low force actuator 1810 moving the seal backing bar 68 to an engaged or sealing position. Arrow 1870 in FIG. 18C illustrates the latch member 1822 of the clamping actuator 1820 moving to a coupling position. Arrow 1880 in FIG. 18D illustrates the clamping actuator 1820 coupling to the low force actuator 1810, to hold the low force actuator 1810 in the clamping position.

Figure 18E:
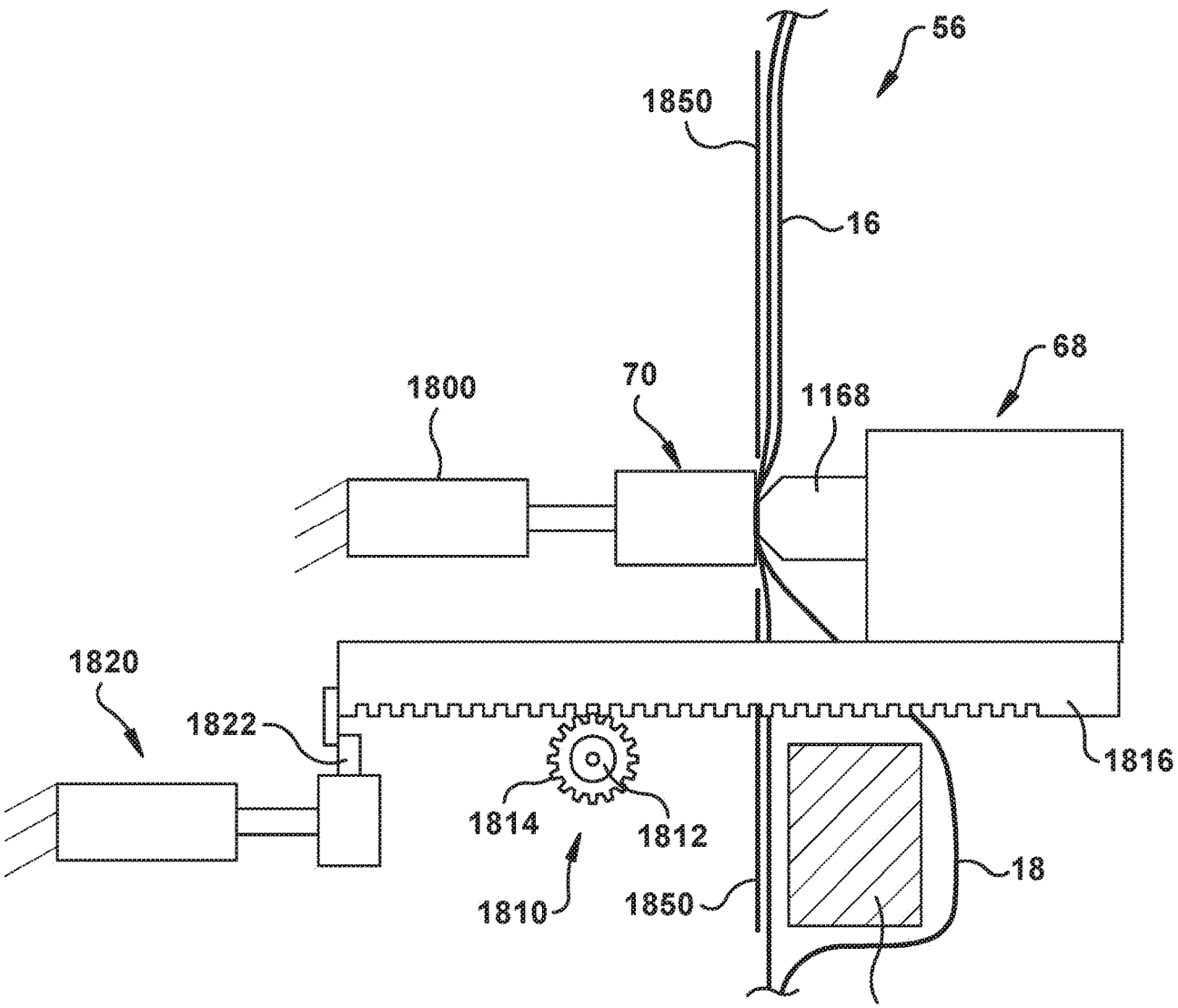

Arrow 1890 in FIG. 18E illustrates the heating element 70 moved by the actuator 1800 to a clamped or seal position. In an exemplary embodiment, the heating element 70 is moved to the clamped position and/or heat is applied by the heating element 70 only after the optional rubber seal backing element 1168 has been moved to the clamped position. The coupled clamping actuator 1820 and low force actuator 1810 prevent the actuator and heating element 70 from pushing the seal backing bar 68 away. That is, the coupled clamping actuator 1820 and low force actuator 1810 can oppose a much larger force applied by the actuator 1800 than the low force actuator 1810 alone. Since, the clamping actuator 1820 is not coupled to the low force actuator 1810 until the seal backing bar is in position, or substantially in position, there is no risk that a user's fingers can be pinched by the forces applied by the actuator 1800 and clamping actuator 1820. The only force that could be applied to a user's fingers is the force applied by the low force actuator 1810, which is lower than a force that could possibly injure a finger. In the illustrated embodiment, the seal backing bar 68 comprises the rubber seal backing element 1168, which is not heated. Heat is applied to the web to seal the plies of the web together. In one exemplary embodiment, the web 16 is reverse indexed while the bag 18 is clamped between the seal backing bar 68 and heating element 70 to separate the bag 18 from the rest of the web. The operations illustrated by FIGS. 18A-18E are performed in reverse order to release the bag.

Figure 12C:
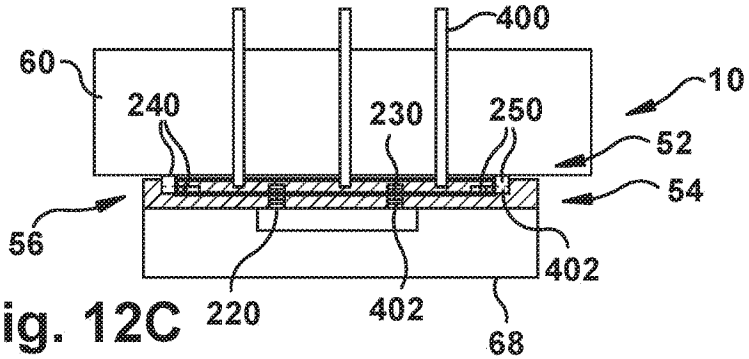
FIG. 12C is a top view of the apparatus and elongated web shown in FIG. 12A.
Figure 12A:
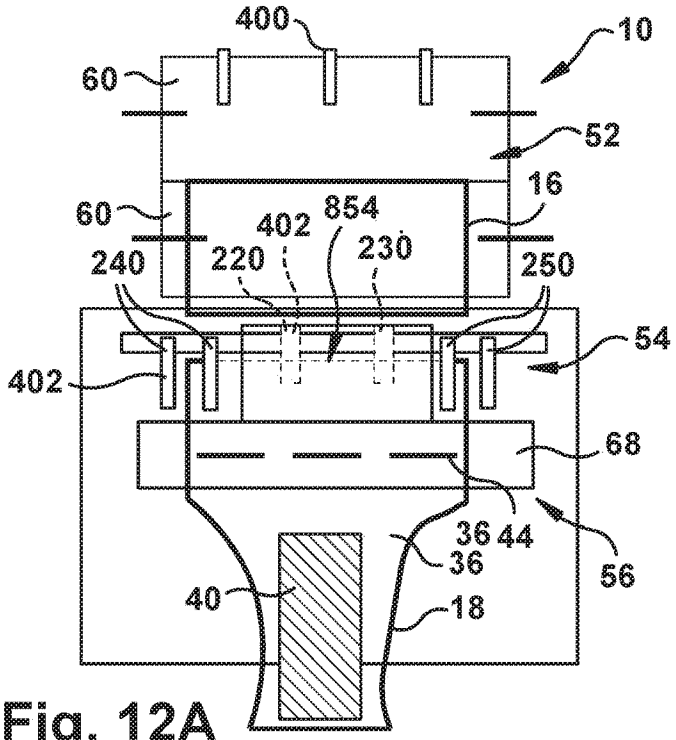
FIG. 12A is a front view of the apparatus showing reverse indexing of the web to separate the filled and sealed bag from the web.
Figure 12B:
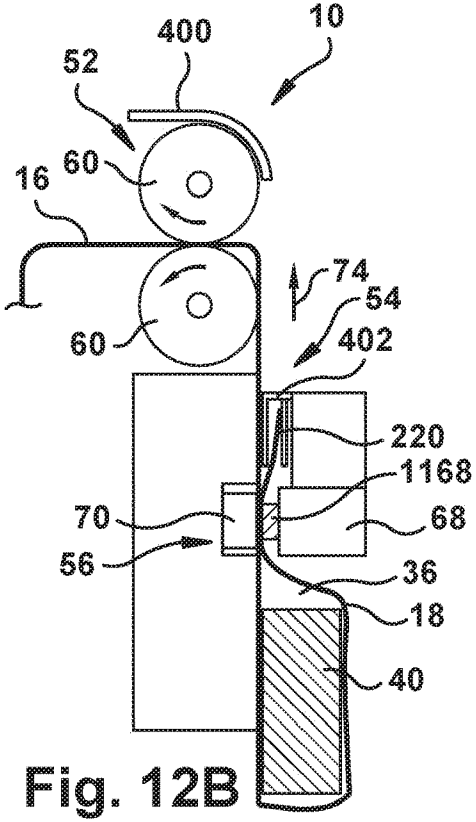
FIG. 12B is a side view of the apparatus and elongated web shown in FIG. 12A.

Referring to FIGS. 12A-12C, the engagement device 402 releases the bag. This release may be after the seal is formed or while the seal is being formed. This release may be before (see FIG. 12B) or after (see FIG. 13B) the seal backing bar 68 and a heating element 70 move apart from one another. In an exemplary embodiment, the controller causes the engagement device 402 to release the bag by causing the grippers 220, 230, 240, 250 to move from the closed position (FIGS. 11A-11C) to the open position (FIGS. 12A-12C).

Still referring to FIGS. 12A-12C, the controller controls the indexing mechanism 52 to separate the formed package 12 from the web 16. The second ply 22 is broken along the remaining middle portion 854 (the middle portion 854 is already broken off in the illustration of FIGS. 12A-12C) of the line of separation 32 to separate the package 12 from the elongated web 16. In the illustrated embodiment, the controller controls the indexing arrangement 52 to pull the web 16 away from the bag 18 as indicated by arrows 74 while the bag is clamped by the sealing arrangement 56 in an exemplary embodiment.

Figure 13C:
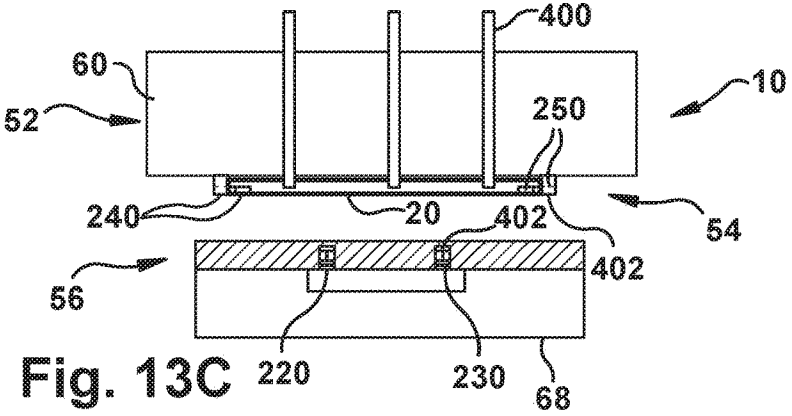
FIG. 13C is a top view of the apparatus and elongated web shown in FIG. 13A.
Figure 13A:
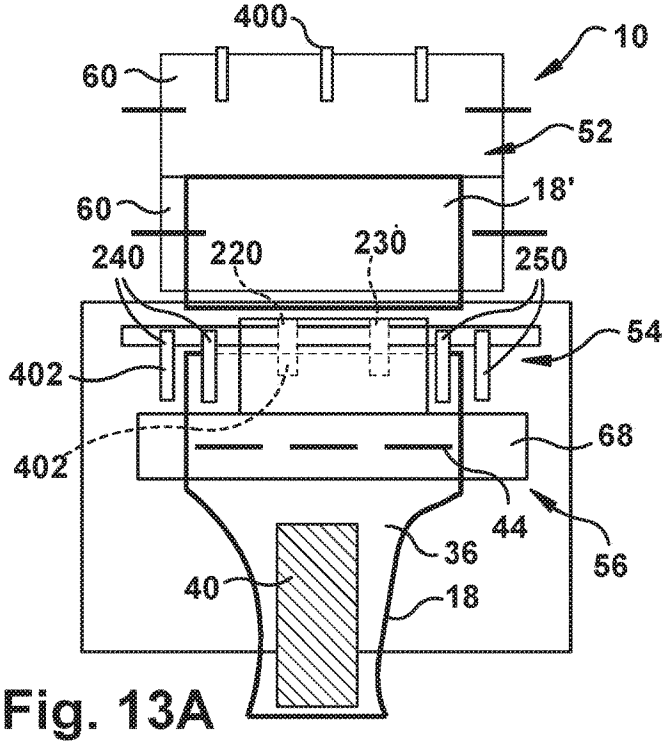
FIG. 13A is a front view of the apparatus showing releasing the filled and sealed bag from the apparatus.
Figure 13B:
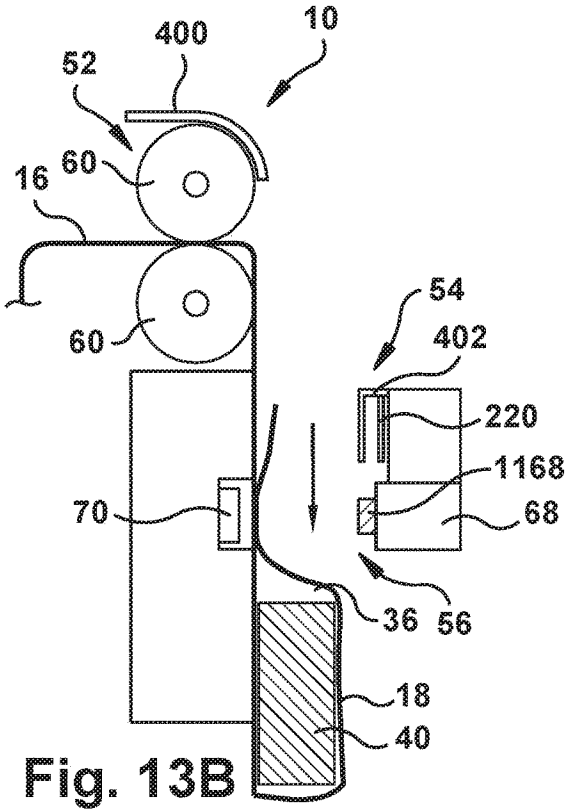
FIG. 13B is a side view of the apparatus and elongated web shown in FIG. 13A.

Referring to FIGS. 13A-13C, the controller controls the sealing arrangement 56 to release the formed package 12 after the filled bag 18 is separated from the next, unfilled bag 18'. In the illustrated embodiment, the formed package 12 is released by moving the seal backing bar 68 away from the heating element 70.

Referring again to FIGS. 3A-3C, the controller indexes the web 16 with the opening 30 of the next bag 18 to the load position and the cycle begins again. The controller may repeat the method as required to produce as many packages are needed from the web.

Figure 19:
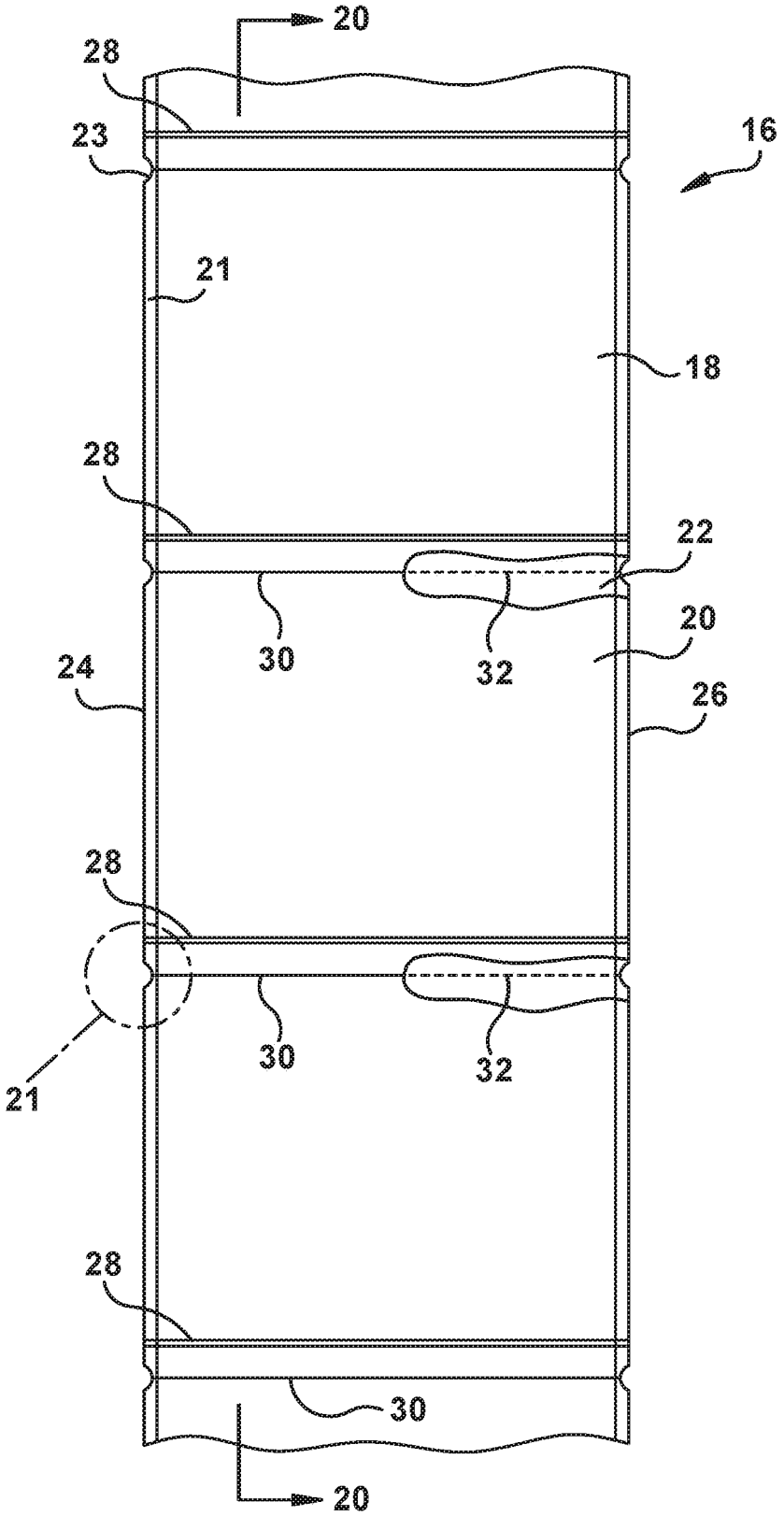
FIG. 19 is a view, partially cut away, of an exemplary embodiment of a new elongated web of bags.
Figure 20:
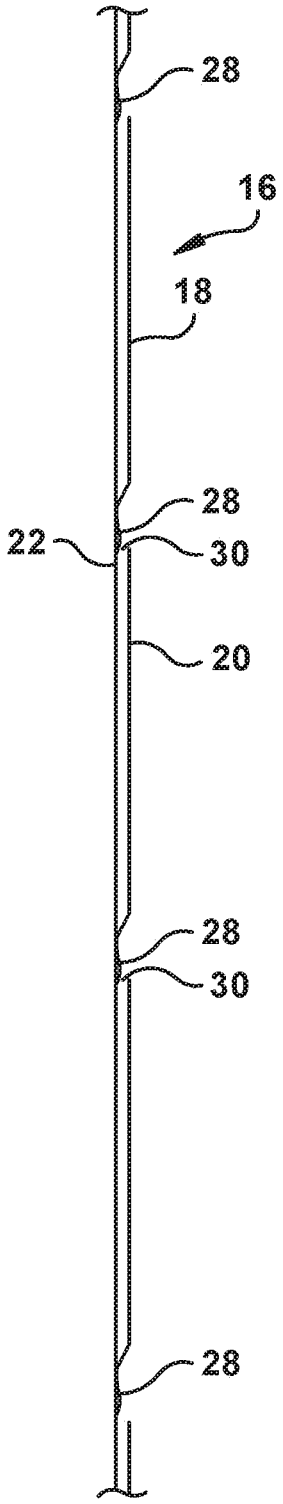
FIG. 20 is a sectional view taken along the plane indicated by lines 20-20 in FIG. 19.

Referring to FIGS. 19-20, exemplary embodiments of a web 16 are shown. Each preformed bag 18 is defined by first and second plies or layers 20, 22 of the web 16. First and second side edges 24, 26 of the web hermetically join the first and second plies. Preformed seals 28 extend between the first and second side edges 24, 26. The opening 30 extends between the first and second side edges 24, 26. The line of separation 32, such as a line of perforations or a line of weakness in the second ply 22 extends between the first and second side edges 24, 26. In one exemplary embodiment, the opening 30 is superposed over the line of separation 32. In another exemplary embodiment, the opening 30 and the line of separation 32 are offset. In some exemplary embodiments, the opening 30 is replaced with a line of perforations or a line of weakness. When the opening 30 is replaced with a line of perforations or a line of weakness, the perforations or line of weakness that replace the opening 30 may optionally be weaker than the perforations or line of weakness of the line of separation 32.

The web 16 of FIG. 19 includes side seals 21 parallel to and proximate the first and second side edges 24, 26. The side seals 21 have a width of about 0.030 inches to about 0.500 inches, such as, for example, 0.100 inches to 0.250 inches. However, the seals 21 may have any range of widths that are within the range of 0.030 inches to 1 inch (i.e. 0.223 to 0.250, 0.8 to 1.0, 0.24 to 0.26, etc., i.e. any sub-range). The relatively thick seals 21 increase the force required to tear a loaded and sealed bag from the remainder of the bags. Cuts 23 in the side seals 21 are aligned with the opening 30 and/or the line of separation 32. The cuts 23 reduce or eliminate the force necessary to break the side seals 21 when the bags 18 are torn along the line of separation 32. The reduced breaking force of the side seals 21 allows the bags 18 to be opened more easily, and prohibits the first and second side edges 24, 26 of adjacent bags 18 from being pulled inward when the bags 18 are opened. The bags 18 may be opened with any of the packaging machines described above, or by the machines described in U.S. Pat. No. 8,307,617 to Riccardi et al. and U.S. Pat. No. 8,887,978 to Chuba, which are incorporated herein by reference in their entirety. The bags 18 may also be opened by hand.

Figure 21A:
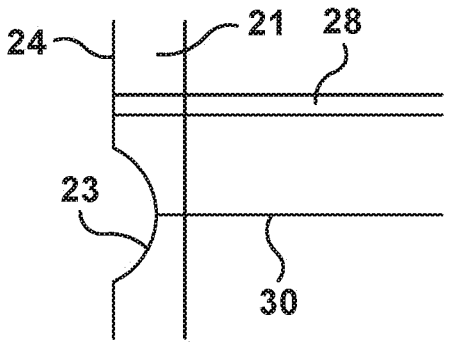
FIGS. 21A-21C are enlarged views of the area of FIG. 19 indicated by the circle 21 in FIG. 19 showing various embodiments of the elongated web of bags with round cuts 23.
Figure 21B:
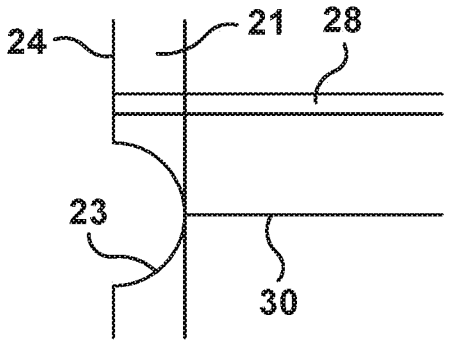
Figure 21C:
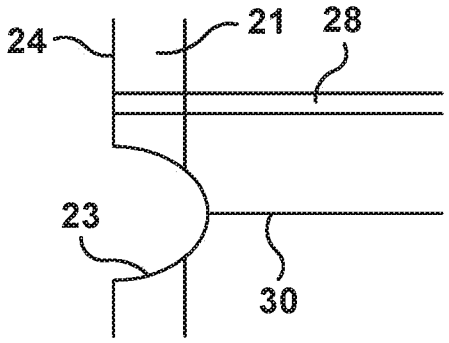
Figure 22A:
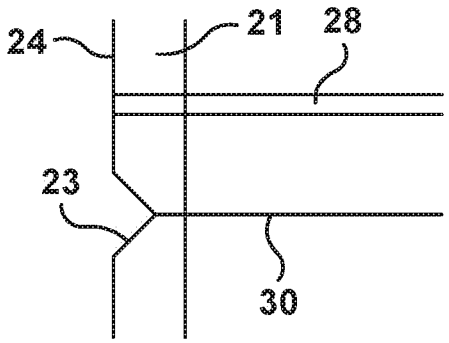
FIGS. 22A-22C are enlarged views of the area of FIG. 19 indicated by the circle 21 in FIG. 19 showing various embodiments of the elongated web of bags with V-shaped cuts 23.
Figure 22B:
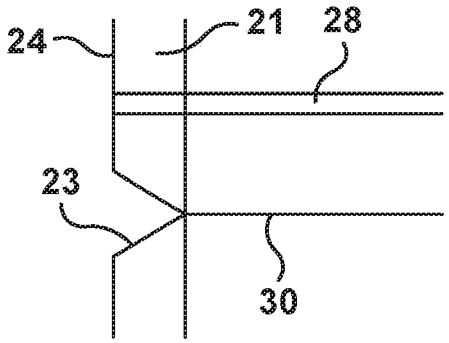
Figure 22C:
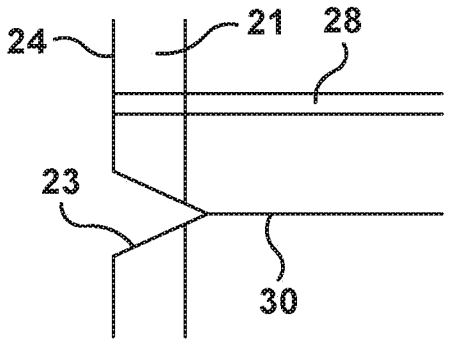
Figure 23A:
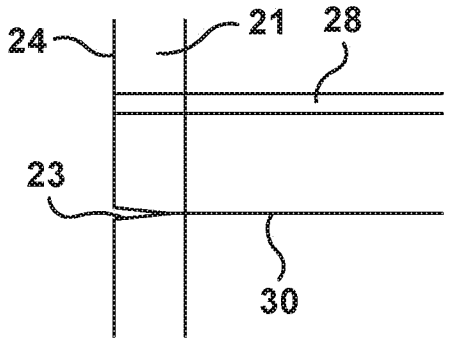
FIGS. 23A-23C are enlarged views of the area of FIG. 19 indicated by the circle 21 in FIG. 19 showing various embodiments of the elongated web of bags with slit cuts 23.
Figure 23B:
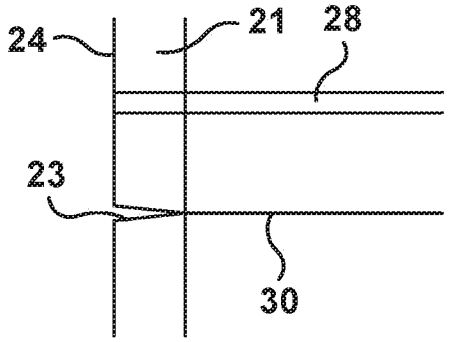
Figure 23C:
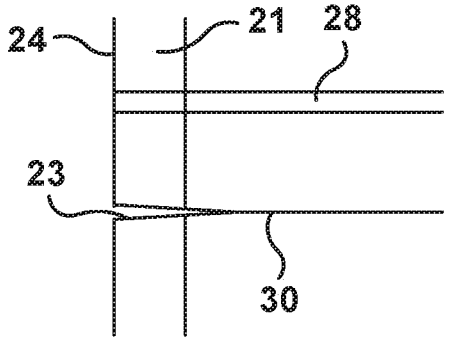

The cuts 23 can take on any suitable shape and have any size. For example, the exemplary embodiments of FIGS. 21A-21C have round cuts 23. The cuts 23 can also be V-shaped, as shown in FIGS. 22A-22C, or a slit, as shown in FIGS. 23A-23C. The cuts 23 may have the same width as the side seals 21, as shown in FIGS. 21B, 22B, and 23B. This eliminates any additional force that is needed to tear the bags apart along the line of perforations 32. The cuts may be narrower than the width of the side seals 21, as shown in FIGS. 21A, 22A, and 23A. For example, the cuts 23 may have a width that is 0.062 inches less than the width of the side seals 21 (or any sub-range between the width of the seals 21 and 0.062 inches less than the width of the seals 21). For example, the cuts may have a width that is 0.031 inches less than the width of the seals 21. The cuts 23 may be wider than the widths of the seals 21, as shown in FIGS. 21C, 22C, and 23C. For example, the cuts 23 may have a width that is up to 0.5 inches wider than the width of the side seals 21 (or any sub-range between the width of the seals 21 to 0.5 inches wider than the width of the seals 21).

It should be understood that the embodiments discussed above are representative of aspects of the invention and are provided as examples and not an exhaustive description of implementations of an aspect of the invention.

While various aspects of the invention are described and illustrated herein as embodied in combination in the exemplary embodiments, these various aspects may be realized in many alternative embodiments, either individually or in various combinations and sub-combinations thereof. Unless expressly excluded herein all such combinations and sub-combinations are intended to be within the scope of the present invention. Still further, while various alternative embodiments as to the various aspects and features of the invention, such as alternative materials, structures, configurations, methods, devices, software, hardware, control logic and so on may be described herein, such descriptions are not intended to be a complete or exhaustive list of available alternative embodiments, whether presently known or later developed. Those skilled in the art may readily adopt one or more of the aspects, concepts or features of the invention into additional embodiments within the scope of the present invention even if such embodiments are not expressly disclosed herein. Additionally, even though some features, concepts or aspects of the invention may be described herein as being a preferred arrangement or method, such description is not intended to suggest that such feature is required or necessary unless expressly so stated. Still further, exemplary or representative values and ranges may be included to assist in understanding the present invention however, such values and ranges are not to be construed in a limiting sense and are intended to be critical values or ranges only if so expressly stated.

What is claimed is:

1. A system comprising:

a supply of a web of preformed bags, the web of preformed bags including first and second layers, first and second side edges, first and second side seals proximate the first and second side edges, a plurality of transverse seals extending between the first and second side edges, an opening in the first layer, and a line of separation in the second layer, and first and second cuts in the first and second side seals, wherein the line of separation is in-line with the opening and the first and second cuts; and a machine comprising:

an indexing mechanism comprising rollers configured to move the web of preformed bags from the supply along a path of travel; and an engagement device located along the path of travel, the engagement device comprising grippers configured to open a bag of the preformed web of bags along the opening to form a shaped opening, the shaped opening comprising:

a first side formed from at least a portion of each of the first layer and the second layer, and a second side formed from at least a portion of each of the first layer and the second layer;

wherein the engagement device is configured to tear the web along portions of the line of separation and to break the first and second side seals when opening the bag; and wherein the first and second cuts are positioned in the web to reduce or eliminate a breaking force necessary to break the first and second side seals when the bag is opened by the engagement device.

2. The system of claim 1, wherein the shaped opening further comprises at least one of:

a third side formed in the first layer between the first and second sides; and a fourth side formed from the second layer between the first and second sides.

3. The system of claim 2, wherein the shaped opening is a rectangular opening that includes the third and fourth sides, wherein the first and second sides are opposite from each other in the rectangular opening, and wherein the third and fourth sides are opposite from each other in the rectangular opening.

4. The system of claim 3, wherein:

a portion of the first cut is formed in the third side of the rectangular opening; and a portion of the second cut is formed in the fourth side of the rectangular opening.

5. The system of claim 1, wherein the shaped opening is in the shape of one of a quadrilateral, a trapezoid, or a triangle.

6. The system of claim 1, wherein the first and second cuts prohibit the first and second side edges of an adjacent bag from moving inward while the engagement device opens the bag.

7. The system of claim 1, wherein the first and second cuts have a cut width that is less than a seal width of the first and second side seals.

8. The system of claim 1, wherein the first and second cuts have a cut width that is substantially equal to a seal width of the first and second side seals.

9. The system of claim 1, wherein the first and second cuts have a cut width that is greater than a seal width of the first and second side seals.

10. The system of claim 1, wherein the opening comprises a first line of separation and the engagement device is configured to open the bag by gripping the opening of the bag such that the first line of separation breaks while the indexing mechanism reverse indexes the web.

11. The system of claim 1, wherein the engagement device is configured to hold the shaped opening of the bag while a product is inserted into the bag, the machine further comprising:

a sealing assembly comprising a seal backing bar configured to seal the bag closed proximate the opening and the line of separation to form a seal in the bag with the product in the bag.

12. The system of claim 11, wherein the sealing assembly is configured to clamp the web while the seal is formed in the bag.

13. The system of claim 12, wherein the indexing mechanism is configured to break the line of separation to separate the bag from the web by reverse indexing the web while the web is clamped by the sealing assembly.

14. The system of claim 12, wherein the sealing assembly includes a seal backing bar configured to move with respect to a housing of the machine and to clamp the web while seal is being formed in the bag.

15. The system of claim 14, wherein the sealing assembly includes a heating element on the housing of the machine and a seal backing element on the seal backing bar, wherein the heating element is configured to apply heat to the web to seal the first and second layers together while the web is clamped by the sealing assembly.

16. A machine for forming packages from a web of preformed bags, the machine comprising:

an indexing mechanism comprising rollers configured to move a web of preformed bags along a path of travel, the web of preformed bags including first and second layers, first and second side edges, first and second side seals proximate the first and second side edges, a plurality of transverse seals extending between the first and second side edges, an opening in the first layer, and a line of separation in the second layer, and first and second cuts in the first and second side seals, wherein the line of separation is in-line with the opening and the first and second cuts; and an engagement device located along the path of travel, the engagement device configured to open a bag of the preformed web of bags along the opening to form a shaped opening, the shaped opening comprising:

a first side formed from at least a portion of each of the first layer and the second layer, and a second side formed from at least a portion of each of the first layer and the second layer;

wherein the engagement device is configured to open the bag such that the web is torn along portions of the line of separation and the first and second side seals are broken; and wherein the first and second cuts are configured to reduce or eliminate a breaking force necessary to break the first and second side seals when the bag is opened by the engagement device;

wherein the engagement device is configured to hold the shaped opening of the bag while a product is inserted into the bag, the machine further comprising a sealing assembly configured to seal the bag closed proximate the opening and the line of separation to form a seal in the bag with the product in the bag;

wherein the sealing assembly is configured to clamp the web while the seal is formed in the bag;

wherein the sealing assembly includes a seal backing bar configured to move with respect to a housing of the machine and to clamp the web while seal is being formed in the bag; and wherein the engagement device includes a first gripper on the seal backing bar and a third gripper on the housing of the machine, and wherein the engagement device is configured to open the bag by gripping the opening of the bag with the at least the first and third grippers while the seal backing bar is moved away from the housing.

17. The machine of claim 16, wherein the engagement device further includes a second gripper on the seal backing bar, and wherein a spacing between the first and second grippers is adjustable based on a width of the shaped opening.

18. The machine of claim 17, wherein the engagement device further includes a fourth gripper on the housing of the machine, and wherein the third and fourth grippers are movable relative to each other.

19. The machine of claim 18, wherein the third and fourth grippers are configured to move away from each other toward the first and second side edges, respectively, so that the engagement device holds the bag closed while the sealing assembly forms the seal in the bag.

* * * * *